US011154790B2

(12) United States Patent
Chen et al.

(10) Patent No.: US 11,154,790 B2
(45) Date of Patent: Oct. 26, 2021

(54) TRANSFORMABLE ROBOT

(71) Applicant: ROBOSEN ROBOTICS (SHENZHEN) CO., LTD, Shenzhen (CN)

(72) Inventors: Xiaosen Chen, Shenzhen (CN); Xudong Wang, Shenzhen (CN); Peihua Liu, Shenzhen (CN)

(73) Assignee: ROBOSEN ROBOTICS (SHENZHEN) CO., LTD, Shenzhen (CN)

( * ) Notice: Subject to any disclaimer, the term of this patent is extended or adjusted under 35 U.S.C. 154(b) by 93 days.

(21) Appl. No.: 16/618,398

(22) PCT Filed: May 31, 2019

(86) PCT No.: PCT/CN2019/089426
§ 371 (c)(1),
(2) Date: Dec. 2, 2019

(87) PCT Pub. No.: WO2020/173011
PCT Pub. Date: Sep. 3, 2020

(65) Prior Publication Data

US 2021/0236950 A1 Aug. 5, 2021

(30) Foreign Application Priority Data

Feb. 28, 2019 (CN) ..... 201910152937.3

(51) Int. Cl.
*A63H 33/00* (2006.01)
*A63H 3/46* (2006.01)
*A63H 17/00* (2006.01)

(52) U.S. Cl.
CPC ..... *A63H 33/003* (2013.01)

(58) Field of Classification Search
CPC ... A63H 3/04; A63H 3/26; A63H 3/46; A63H 17/004; A63H 17/02; A63H 17/26; A63H 33/003; A63H 33/26
USPC ..... 446/93, 94, 95, 275, 279, 321, 376, 465, 446/487
See application file for complete search history.

(56) References Cited

U.S. PATENT DOCUMENTS 4,206,564 A * 6/1980 Ogawa ..... A63H 33/003 446/94
4,391,060 A * 7/1983 Nakane ..... A63H 33/003 446/94

(Continued)

FOREIGN PATENT DOCUMENTS

CN 205252529 U 5/2016
CN 205699429 U 11/2016

(Continued)

*Primary Examiner* — Alexander R Niconovich
(74) *Attorney, Agent, or Firm* — Bayramoglu Law Offices LLC

(57) ABSTRACT

A transformable robot, including a car body, under which the robot is equipped with a right leg and a left leg side by side, and on the upper part of which a right arm is on the right side and a left arm is on the left side. A car head is set in front of the car body and a carriage is set on the back of the car body. A head of the robot is installed on the top of the car body, and the right leg, the left leg, the right arm and the left arm are rotatably installed on the car body.

31 Claims, 20 Drawing Sheets

(56) References Cited

U.S. PATENT DOCUMENTS 4,411,097 A * 10/1983 Murakami ..... A63H 3/16 446/376
4,516,948 A * 5/1985 Obara ..... A63H 33/003 446/376
4,571,203 A * 2/1986 Murakami ..... A63H 33/003 446/376
4,578,046 A * 3/1986 Ohno ..... A63H 33/003 446/376
4,580,993 A * 4/1986 Ohno ..... A63H 33/003 446/376
4,586,911 A * 5/1986 Murakami ..... A63H 33/003 446/376
4,682,969 A * 7/1987 Choy ..... A63H 33/003 446/279
6,482,068 B2 * 11/2002 Lee ..... A63H 3/46 446/376
7,445,538 B2 * 11/2008 Hanamoto ..... A63H 3/04 446/321
8,066,542 B2 * 11/2011 Ejima ..... A63H 33/003 446/93
8,128,450 B2 * 3/2012 Imai ..... A63H 17/004 446/14
8,187,049 B2 * 5/2012 Corsiglia ..... A63H 33/003 446/37
8,337,271 B2 * 12/2012 Campbell ..... A63H 17/00 446/376
9,067,147 B1 * 6/2015 Woodhouse ..... A63H 33/003
9,415,322 B2 * 8/2016 Kanauchi ..... A63H 33/003
9,808,731 B1 * 11/2017 Liu ..... A63H 33/003
10,307,684 B2 * 6/2019 Choi ..... A63H 17/02
10,561,957 B2 * 2/2020 Choi ..... A63H 33/003
10,773,177 B2 * 9/2020 Ishida ..... A63H 17/26
2006/0189251 A1 * 8/2006 Okamoto ..... A63H 11/00 446/376
2006/0258260 A1 * 11/2006 Okamoto ..... A63H 11/00 446/321
2007/0155276 A1 * 7/2007 Hanamoto ..... A63H 3/04 446/93
2007/0167108 A1 * 7/2007 Hanamoto ..... A63H 3/46 446/321
2008/0233833 A1 * 9/2008 Toriyama ..... A63H 17/02 446/321
2009/0209167 A1 * 8/2009 Ejima ..... A63H 17/02 446/93
2009/0209168 A1 * 8/2009 Ejima ..... A63H 17/02 446/93
2009/0233519 A1 * 9/2009 Ejima ..... A63H 33/003 446/376
2011/0111672 A1 * 5/2011 Miyake ..... A63H 17/02 446/378
2012/0142247 A1 * 6/2012 Hara ..... A63H 33/003 446/72
2014/0370777 A1 * 12/2014 Minassian ..... A63H 33/003 446/102
2015/0196850 A1 * 7/2015 Kobayashi ..... A63H 33/003 446/376
2015/0314209 A1 * 11/2015 Brooks ..... A63H 3/46 446/128
2018/0078870 A1 * 3/2018 Yu ..... A63H 17/004
2018/0133612 A1 * 5/2018 Choi ..... A63H 33/003
2018/0147502 A1 * 5/2018 Choi ..... A63H 33/003
2018/0169537 A1 * 6/2018 Choi ..... A63H 3/04
2019/0118106 A1 * 4/2019 Ishida ..... A63H 3/20
2019/0291016 A1 * 9/2019 Choi ..... A63F 1/04

FOREIGN PATENT DOCUMENTS

CN 106823393 A 6/2017
CN 108371820 A 8/2018
CN 208340114 U 1/2019
GB 2155798 A 10/1985
JP 0759952 A 3/1995

* cited by examiner

TRANSFORMABLE ROBOT

CROSS REFERENCE TO THE RELATED APPLICATIONS

This application is the national phase entry of International Application No. PCT/CN2019/089426, filed on May 31, 2019, which is based upon and claims priority to Chinese Patent Application No. 201910152937.3, filed on Feb. 28, 2019, the entire contents of which are incorporated herein by reference.

TECHNICAL FIELD

The present invention relates to a transformable robot.

BACKGROUND

A Chinese patent with patent number ZL201810259246.9 discloses a transformable robot and its transforming method and an automatically reset method of combined steering gear, wherein the transformable robot comprises a car body, components for standing, and components for supporting, the components for standing are set at the lower part of the car body, while the components for supporting are set at both sides of the upper part of the car body, the components for standing and the components for supporting are rotatablely connected with the car body respectively, the transformable robot also comprises components for executing which are set at the back of the car body. The components for executing which are used to realize the transformation of vehicle, and both the components for supporting which are used to support the car body during the transformation make driving force of the components for standing reduced greatly when standing to ensure the balance of force during transformation and to realize quickly transformation, at the same time, the automatically reset method of combined steering gear were realized. However, without the car head set in front of the car body and the carriage set at the back of the car body, the Chinese patent could not realize the transformation of the car body with the car head and the carriage, and was only applicable to the transformable robot of engineering vehicles, therefore, further improvement for transformable robot is needed.

SUMMARY

The present invention provides a transformable robot to overcome the defects in the prior art, and the transformable robot is described as following.

The transformable robot comprises a car body, under the car body, a right leg and a left leg of the robot are equipped side by side. A right arm and a left arm are located respectively on the right side and the left side of the upper part of the car body. A car head is set in the front of the car body, a carriage is set at the back of the car body, a head is set on the top of the car body. And the right leg, the left leg, the right arm and the left arm are rotatablely installed on the car body respectively.

Preferably, the head comprises a back part of the head, eyes, a face, a front part of the head, a neck and a supporting frame for head, the eyes are set inside the face, the face is set inside the back part of the head by a first round head self-tapping screw, the front part of the head is set on the outside of the face, the neck is set at the bottom of the head, the supporting frame for head is installed at the bottom of the neck by a rotating shaft and a torsion spring which is assembled on the rotating shaft, a PCB is set on the upper part of the neck.

Preferably, the car head comprises a first frame in the car head, two steering gears with metal teeth for the car head, a second frame in the car head, a right cover for grille, a PCB for head light, a right head light, a right torsion spring for the car head, a right car head, a grille, a left car head, a left torsion spring for the car head, a left head light, a left cover for grille. The left car head is connected with the grille by a fifth round head self-tapping screw and a first flange self-tapping screw, and a shim and the left torsion spring for car head assembled on the fifth round head self-tapping screw. At the same time the right car head is connected with the grille by another fifth round head self-tapping screw and another first flange self-tapping screw, and another shim and the right torsion spring for car head assembled on the another fifth round head self-tapping screw. The left head light is set inside of the left car head, the right head light is set inside of the right car head. Two printed circuit boards for head light which are connected with the left car head and the right car head respectively. In the left car head and the right car head, a first frame in car head, two steering gears with metal teeth for car head, and the second frame in car head are internally equipped. The left cover for grille is set at the back of the left car head, and the right cover for grille is set at the back of the right car head.

Preferably, the car body comprises a first steering gear for car body, a second steering gear for car body, a third steering gear for car body, a fourth steering gear for car body, a fifth steering gear for car body, a bottom for car head, a sheet metal parts at the back of the car body, a PCB for control, an armpit, a fifth part of waist, a sheet metal parts at the front of the car body, a first part of waist, a second part of waist, a third part of waist, a fourth part of waist, a sheet metal parts under the steering gear for grille, a sheet metal parts above the steering gear for grille. The fifth steering gear for car body is equipped between the sheet metal parts under the steering gear for grille and the sheet metal parts above the steering gear for grille. On two opposite sides of the sheet metal parts at the front of the car body and the sheet metal parts at the back of the car body, the car head, the armpit, the first steering gear for car body, the second steering gear for car body, the third steering gear for car body, the fourth steering gear for car body and the fifth part of waist are set respectively. The first steering gear for car body and the second steering gear for car body are horizontally installed on the upper part of the car body side by side, while the third steering gear for car body and the fourth steering gear for car body are horizontally installed on the lower part of the car body side by side. The PCB for control is installed on the other side of the sheet metal parts at the back of the car body.

Preferably, the carriage comprises a car roof, a horn, an acoustic chamber, an exhaust at the rear right, a battery box, two batteries, a cover for the battery box, an exhaust at the front right, a PCB for microphone, a PCB for switch, a charging interface, buttons, a small size supporting frame, a USB interface, a microphone box, a microphone, a cover for the microphone box, a rubber sleeve, an exhaust at the front left, windows, a right torsion spring for window, a torsion spring for exhaust, a first shaft for the carriage, a left torsion spring for window, a second shaft for the carriage, lampshades for roof light, a supporting frame for roof light, a PCB for roof light, roof lights, an exhaust at the rear left, a tailpipe. Two sides of the roof are equipped with the exhaust at the rear right, the exhaust at the front right, the exhaust at the front left, and the exhaust at the rear left and the tailpipe.

The supporting frame for roof light is installed in the rear of the roof. The PCB for roof light, the roof lights, the lampshades for roof light are successively equipped on the supporting frame for roof light. The lower part of the roof is connected with the windows using the first shaft for the carriage, in which the left torsion spring for window and the right torsion spring for window are assembled on. The horn, the acoustic chamber, the battery box, the two batteries, the cover of the battery box, the PCB for microphone, the PCB for switch, the charging interface, the buttons, the small size supporting frame, and the USB interface are set at the front of the roof. The microphone box, the microphone, the cover for the microphone box, and the rubber sleeve are set at the bottom of the roof.

Preferably, the right arm comprises a tire at front right, a wheel at front right, a fixing frame for the wheel at front right, a supporting frame for the wheel at front right, a first circlip, a frame for the wheel at front right, a first spring, a shaft for the wheel at front right, a hang frame for the right arm, a second cover for the right arm, a shaft for right upper arm, a second spring, a mounting part for spring on the right arm, a first cover for the right arm, a barrel on the right arm, a second U-shaped part on right shoulder, a first U-shaped part on right shoulder, a forward frame for steering gear at elbow of right arm, a steering gear with metal teeth for right arm, a backward frame for steering gear at elbow of right arm, a third part of elbow of right arm, a first part of elbow of right arm, a second part of elbow of right arm, a right palm, a right wrist, a back of right hand, a clip for wiring on right arm, a ladder on right arm, an elbow of right arm, a trim on right arm. The hang frame for the right arm is connected with the frame for the wheel at front right, while the frame for the wheel at front right is connected with the supporting frame for the wheel at front right. The fixing frame for the wheel at front right is installed on the supporting frame for the wheel at front right. The tire at front right and the wheel at front right are equipped on the fixing frame for the wheel at front right. The first cover for the right arm, the barrel on the right arm, the second U-shaped part on right shoulder, the first U-shaped part on right shoulder, the axis for right upper arm, the second spring and the mounting part for spring on the right arm are equipped on the second cover for the right arm. The steering gear with metal teeth for right arm is set between the forward frame for steering gear at elbow of right arm and the backward frame for steering gear at elbow of right arm. The third part of elbow of right arm, the first part of elbow of right arm and the second part of elbow of right arm are assembled together and the upper part thereof is connected with the elbow of right arm, the lower part thereof is connected with the right wrist, while the right wrist is connected with the right palm.

Preferably, the left arm comprises a steering gear on the top of the left arm, a steering gear on the middle of the left arm, a tire at front left, a wheel at front left, a fixing frame for the wheel at front left, a supporting frame for the wheel at front left, a second circlip, a frame for the wheel at front left, a fifth spring, a shaft for the wheel at front left, a hang frame for the left arm, a second cover for the left arm, a shaft for left upper arm, a sixth spring, a mounting part for spring on the left arm, a first cover for the left arm, a barrel on the left arm, a second U-shaped part on left shoulder, a first U-shaped part on left shoulder, a forward frame for steering gear at elbow of left arm, a steering gear with metal teeth for left arm, a backward frame for steering gear at elbow of left arm, a third part of elbow of left arm, a first part of elbow of left arm, a second part of elbow of left arm, a left palm, a left wrist, a back of left hand, a clip for wiring on left arm, a ladder on left arm, a elbow of left arm, a trim on left arm. The hang frame for the left arm is connected with the frame for the wheel at front left, while the frame for the wheel at front left is connected with the supporting frame for the wheel at front left. The fixing frame for the wheel at front left is installed on the supporting frame for the wheel at front left. The tire at front left and the wheel at front left are equipped on the fixing frame for the wheel at front left. The first cover for the left arm, the, barrel on the left arm the second U-shaped part on left shoulder, the first U-shaped part on left shoulder, the shaft for left upper arm, the sixth spring and the mounting part for spring on the left arm are equipped on the second cover for the left arm. The steering gear with metal teeth for left arm is set between the forward frame for steering gear with metal teeth for left arm and the backward frame for steering gear at elbow of left arm. The third part of elbow of left arm, the first part of elbow of left arm and the second part of elbow of left arm are assembled together and the upper part thereof is connected with the elbow of left arm, the lower part thereof is connected with the left wrist, while the left wrist is connected with the left palm. The steering gear on the top of the left arm is set on the top of the left arm, while the steering gear on the middle of the left arm is set on the middle of the left arm.

Preferably, the right leg comprises a sole of right foot, a right foot, a instep of right foot, a first frame for right foot, a second frame for right foot, a first steering gear for right leg, a fourth fixing plate for right leg, a trim on right knee, a first U-shaped part on cover for right knee, a cover for right knee, a right knee, a torsion spring for right leg, a shaft for torsion spring for right leg, an upper cover for right knee, a trim for right leg, a fourth U-shaped part for right leg, an inside of right leg, a first U-shaped part for right leg, a second U-shaped part for right leg, a sixth U-shaped part for right leg, an outer of right leg, a third U-shaped part for right leg, a fifth U-shaped part for right leg, a second U-shaped part on cover for right knee, a third fixing plate for right leg, a second steering gear for right leg, a third steering gear for right leg, a fourth steering gear for right leg, a fifth steering gear for right leg, a wheel at rear right, a tire at rear right, a first U-shaped part for right foot, a second U-shaped part for right foot, a shaft for right foot, a second fixing plate for right leg, a circlip for right leg, a first fixing plate for right leg. The sole of right foot is installed at the bottom of the right foot, and the instep of right foot is installed on the top of the right foot, the first frame for right foot, the second frame for right foot, the second fixing plate for right leg and the first fixing plate for right leg are installed on the top of the instep of right foot. The third steering gear for right leg is set between the second fixing plate for right leg and the first fixing plate for right leg. The first steering gear for right leg is equipped in the space which is formed by the first frame for right foot, the second frame for right foot, the first U-shaped part for right foot and the second U-shaped part for right foot. The upper part of the right knee is connected with the upper cover for right knee by the torsion spring for right leg and the shaft for torsion spring for right leg. The cover for right knee is equipped at front of the right knee, the inside of right leg is equipped on the outside of the right knee, the fourth U-shaped part for right leg is equipped on the upper part of the inside of right leg. The inside of right leg is set opposite to the outer of right leg, the fourth steering gear for right leg and the fifth steering gear for right leg are installed between the inside of right leg and the outer of right leg side by side. The third U-shaped part for right leg is installed on the outside of the outer of right leg, the fifth U-shaped part for right leg is installed on the outside of the third U-shaped part for right leg, the first U-shaped part for right leg and the second U-shaped part for right leg are installed on the back of the inside of right leg and the outer of right leg. The sixth U-shaped part for right leg is installed on the outside of the second U-shaped part for right leg. The second U-shaped part on cover for right knee, the third fixing plate for right leg, the second steering gear for right leg, the wheel at rear right and the tire at rear right are successively equipped on the lower part of the outer of right leg.

Preferably, the left leg comprises a sole of left foot, a left foot, a instep of left foot, a first frame for left foot, a second frame for left foot, a first steering gear for left leg, a fourth fixing plate for left leg, a trim on left knee, a first U-shaped part on cover for left knee, a cover for left knee, a left knee, a torsion spring for left leg, a shaft for torsion spring for left leg, an upper cover for left knee, a trim for left leg, a fourth U-shaped part for left leg, an inside of left leg, a first U-shaped part for left leg, a second U-shaped part for left leg, a sixth U-shaped part for left leg, an outer of left leg, a third U-shaped part for left leg, a fifth U-shaped part for left leg, a second U-shaped part on cover for left knee, a third fixing plate for left leg, a second steering gear for left leg, a third steering gear for left leg, a fourth steering gear for left leg, a fifth steering gear for left leg, a wheel at rear left, a tire at rear left, a first U-shaped part for left foot, a second U-shaped part for left foot, a shaft for left foot, a second fixing plate for left leg, a circlip for left leg, a first fixing plate for left leg. The third steering gear for left leg is set between the second fixing plate for left leg and the first fixing plate for left leg. The first steering gear for left leg is equipped in the space which is formed by the first frame for left foot, the second frame for left foot, the first U-shaped part for left foot and the second U-shaped part for left foot. The upper part of the left knee is connected with the upper cover for left knee by the torsion spring for left leg and the shaft for torsion spring for left leg. The cover for left knee is equipped at front of the left knee, and the inside of left leg is equipped on the outside of the left knee, the fourth U-shaped part for left leg is equipped on the upper part of the inside of left leg. The inside of left leg is set opposite to the outer of left leg, the fourth steering gear for left leg and the fifth steering gear for left leg are installed between the inside of left leg and the outer of left leg side by side. The third U-shaped part for left leg is installed on the outside of the outer of left leg, the fifth U-shaped part for left leg is installed on the outside of the third U-shaped part for left leg, and the first U-shaped part for left leg and the second U-shaped part for left leg are installed on the back of the inside of left leg and of the outer of left leg. The sixth U-shaped part for left leg is installed on the outside of the second U-shaped part for left leg. The second U-shaped part on cover for left knee, the third fixing plate for left leg, the second steering gear for left leg, the wheel at rear left and the tire at rear left are successively equipped on the lower part of the outer of left leg.

The present invention provides a transforming method of the transformable robot to overcome the defects in the prior art, and the transforming method of the transformable robot is described as following.

The transforming method of the transformable robot includes a transforming process from vehicle form to robot form and a transforming process from the robot form to the vehicle form. The transformable robot implementing the two transforming processes refer to the transformable robot mentioned in the above description, and wherein, the transforming process from the vehicle form to the robot form includes:

step one: the transformable robot is powered on, and a transformation program is started;

step two: the left leg and the right leg are opened;

step three: the left arm and the right arm are opened, and the left leg and the right leg continue to be opened;

step four: the left arm and the right arm continue to be opened until they are perpendicular to the ground, and then the left leg and the right leg continue to be opened;

step five: the left leg and the right leg continue to be opened until they are perpendicular to the ground;

step six: the car body, the car head and the carriage are opened partially, the left leg and the right leg are opened completely, and the left arm and the right arm are opened completely;

step seven: the car body, the car head and the carriage are turned forward 90 degrees, and the head is protruded from the car body;

step eight: the left leg and the right leg are rotated outwards respectively, driving the left foot and the right foot to be rotated outwards respectively, then the combination formed by the left leg and the left foot, the combination formed by the right leg and the right foot are separated from each other at a certain angle to form a stable standing state. The transformation process from the vehicle form to the robot form is completed.

The transformation process from the robot form to the vehicle form is an inverse process of the transformation process from the vehicle form to the robot form.

According to the present invention, the car head and the carriage are equipped in front of the car body and at the back of the car body respectively, both are improved in respect of the transformability, and therefore more different transformed shapes can be gotten, which results enjoyment of the robot compared with those in the prior art.

DESCRIPTION OF REFERENCE MARK SHOWN IN FIG. 1 TO FIG. 16

Figure 1:
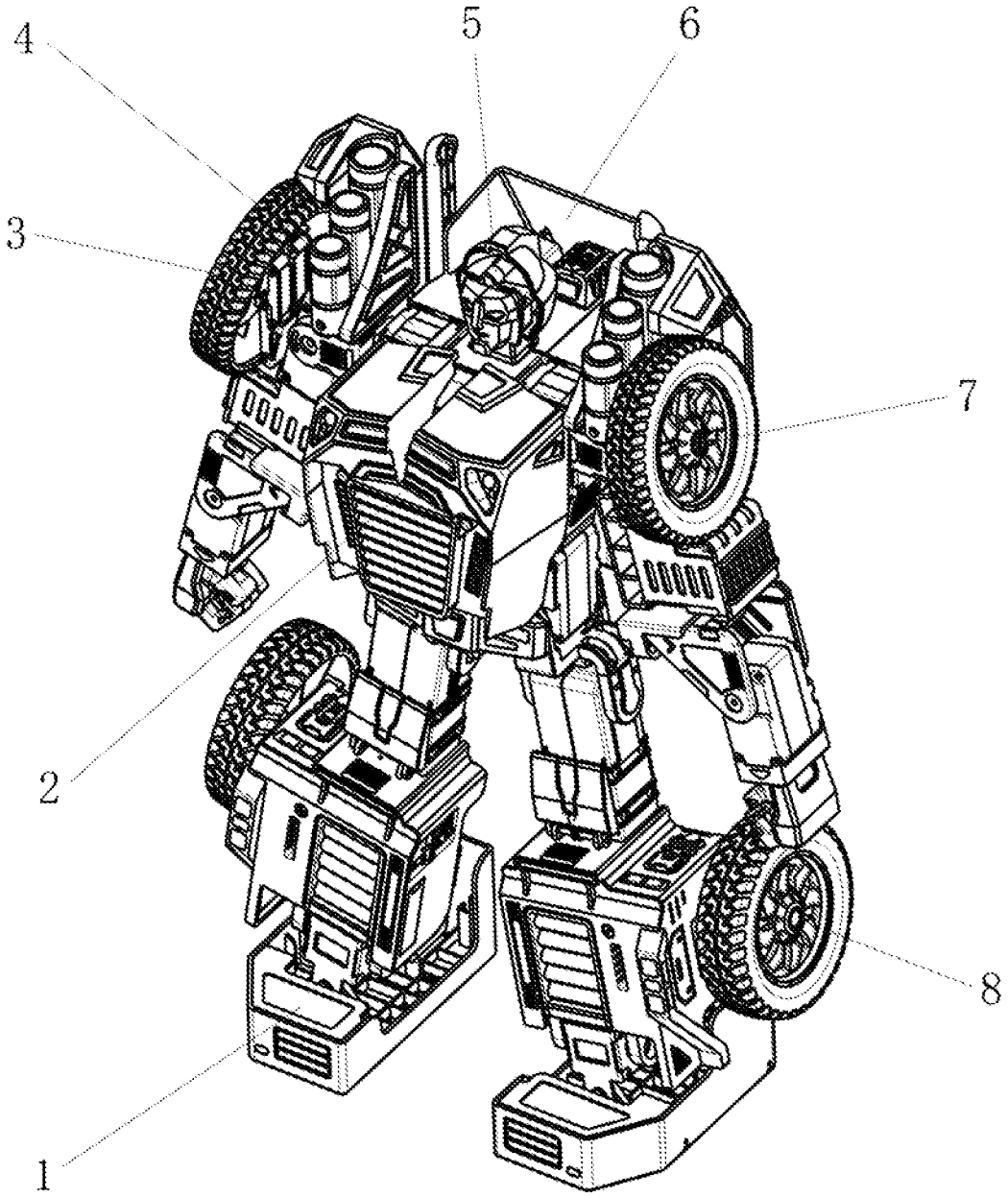
FIG. 1 is a perspective view of robot form described in a preferred embodiment of the transformable robot according to the present invention.

For the structure of the whole: 1—right leg; 2—car head; 3—right arm; 4—car body; 5—head; 6—carriage; 7—left arm; 8—left leg.

For the structure of the head: 9—first round head self-tapping screw; 10—back part of the head; 11—printed circuit board (PCB); 12—eye; 13—face; 14—front part of the head; 15—supporting frame for head; 16—torsion spring; 17—rotating shaft; 18—neck.

For the structure of the car head: 19—first frame in car head; 20—second round head self-tapping screw; 21—steering gear with metal teeth for car head; 22—second frame in car head; 23—right cover for grille; 24—third round head self-tapping screw; 25—fourth round head self-tapping screw; 26—PCB for head light; 27—fifth round head self-tapping screw; 28—right head light; 29—shim; 30—right torsion spring for car head; 31—first flange self-tapping screw; 32—right car head; 33—grille; 34—left car head; 35—left torsion spring for car head; 36—left head light; 37—left cover for grille; 38—first flange metric screw; 39—sixth round head self-tapping screw.

For the structure of the car body: 40—first steering gear for car body; 41—bottom for car head; 42—first flat head self-tapping screw; 43—sheet metal parts at the back of the car body; 44—seventh round head self-tapping screw; 45—PCB for control 46—first round head metric screw; 47—second flat head self-tapping screw; 48—eighth round head self-tapping screw; 49—ninth round head self-tapping screw; 50—armpit; 51—tenth round head self-tapping screw; 52—fifth part of waist; 53—sheet metal parts at the front of the car body; 54—eleventh round head self-tapping screw; 55—first part of waist; 56—second part of waist; 57—third part of waist; 58—fourth part of waist; 59—twelfth round head self-tapping screw; 60—third flat head self-tapping screw; 61—second round head metric screw; 62—sheet metal parts under the steering gear for grille; 63—thirteenth round head self-tapping screw; 64—fourteenth round head self-tapping screw; 65—sheet metal parts above the steering gear for grille; 66—fifteenth round head self-tapping screw; 67—fourth flat head self-tapping screw.

For the structure of the carriage: 68—roof; 69—fifth flat head self-tapping screw; 70—sixteenth round head self-tapping screw; 71—horn; 72—acoustic chamber; 73—seventeenth round head self-tapping screw; 74—exhaust at the rear right; 75—battery box; 76—battery; 77—cover for the battery box; 78—eighteenth round head self-tapping screw; 79—exhaust at the front right; 80—PCB for microphone; 81—nineteenth round head self-tapping screw; 82—twentieth round head self-tapping screw; 83—PCB for switch; 84—charging interface; 85—twenty-first round head self-tapping screw; 86—button; 87—small size supporting frame; 88—USB interface; 89—twenty-second round head self-tapping screw; 90—microphone box; 91—microphone; 92—cover for the microphone box; 93—rubber sleeve; 94—exhaust at the front left; 95—window; 96—right torsion spring for window; 97—torsion spring for exhaust; 98—first shaft for the carriage; 99—left torsion spring for window; 100—second shaft for the carriage; 101—lampshade for roof light; 102—supporting frame for roof light; 103—PCB for roof light; 104—roof light; 105—exhaust at the rear left; 106—tailpipe.

For the structure of the right arm: 107—flange self-tapping screw; 108—tire at front right; 109—wheel at front right; 110—fixing frame for the wheel at front right; 111—supporting frame for the wheel at front right; 112—sixth flat head self-tapping screw; 113—first circlip; 114—frame for the wheel at front right; 115—first spring; 116—shaft for the wheel at front right; 117—hang frame for the right arm; 118—twenty-third round head self-tapping screw; 119—second cover for the right arm; 120—shaft for right upper arm; 121—second spring; 122—mounting part for spring on the right arm; 123—first cover for the right arm; 124—barrel on the right arm; 125—second U-shaped part on right shoulder; 126—first U-shaped part on right shoulder; 127—second flange metric screw; 128—forward frame for steering gear at elbow of right arm; 129—steering gear with metal teeth for right arm; 130—backward frame for steering gear at elbow of right arm; 131—twenty-fourth round head self-tapping screw; 132—seventh flat head self-tapping screw; 133—third part of elbow of right arm; 134—round head metric screw; 135—first part of elbow of right arm; 136—second part of elbow of right arm; 137—twenty-fifth round head self-tapping screw; 138—right palm; 139—right wrist; 140—back of right hand; 141—twenty-sixth round head self-tapping screw; 142—clip for wiring on right arm; 143—ladder on right arm; 144—elbow of right arm; 145—trim on right arm; 146—twenty-seventh round head self-tapping screw.

For the structure of the left arm: 147—barrel on the left arm; 148—twenty-eighth round head self-tapping screw; 149—first cover for the left arm; 150—shaft for left upper arm; 151—mounting part for spring on the left arm; 152—sixth spring; 153—second cover for the left arm; 154—shaft for the wheel at front left; 155—fifth spring; 156—second circlip; 157—frame for the wheel at front left; 158—eighth flat head self-tapping screw; 159—supporting frame for the wheel at front left; 160—fixing frame for the wheel at front left; 161—wheel at front left; 162—tire at front left; 163—second flange self-tapping screw; 164—hang frame for the left arm; 165—twenty-ninth round head self-tapping screw; 166—trim on left arm; 167—elbow of left arm; 168—ladder on left arm; 169—thirtieth round head self-tapping screw; 170—thirtieth-first round head self-tapping screw; 171—left wrist; 172—back of left hand; 173—left palm; 174—thirtieth-second round head self-tapping screw; 175—clip for wiring on left arm; 176—second part of elbow of left arm; 177—steering gear with metal teeth for left arm; 178—round head metric screw; 179—third flange metric screw; 180—first part of elbow of left arm; 181—third part of elbow of left arm; 182—ninth flat head self-tapping screw; 183—forward frame for steering gear at elbow of left arm; 184—backward frame for steering gear at elbow of left arm; 185—first U-shaped part on left shoulder; 186—second U-shaped part on left shoulder.

For the structure of the right leg: 187—first cross recessed round head self-tapping screw; 188—sole of right foot; 189—right foot; 190—instep of right foot; 191—first frame for right foot; 192—second frame for right foot; 193—first steering gear for right leg; 194—second cross recessed round head self-tapping screw; 195—fourth fixing plate for right leg; 196—trim on right knee; 197—first U-shaped part on cover for right knee; 198—cover for right knee; 199—right knee; 200—torsion spring for right leg; 201—shaft for torsion spring for right leg; 202—upper cover for right knee; 203—trim for right leg; 204—third cross recessed round head self-tapping screw; 205—first cross recessed round head flange bolt; 206—fourth U-shaped part for right leg; 207—inside of right leg; 208—first U-shaped part for right leg; 209—fourth cross recessed round head self-tapping screw; 210—second U-shaped part for right leg; 211—sixth U-shaped part for right leg; 212—outer of right leg; 213—third U-shaped part for right leg; 214—fifth U-shaped part for right leg; 215—second U-shaped part on cover for right knee; 216—third fixing plate for right leg; 217—second steering gear for right leg; 218—wheel at rear right; 219—tire at rear right; 220—first cross recessed round head flange self-tapping screw; 221—first U-shaped part for right foot; 222—second U-shaped part for right foot; 223—shaft for right foot; 224—second fixing plate for right leg; 225—circlip for right leg; 226—first fixing plate for right leg.

For the structure of the left leg: 227—fifth cross recessed round head self-tapping screw; 228—sole of left foot; 229—left foot; 230—instep of left foot; 231—first frame for left foot; 232—second frame for left foot; 233—first steering gear for left leg; 234—sixth cross recessed round head self-tapping screw; 235—fourth fixing plate for left leg; 236—trim on left knee; 237—first U-shaped part on cover for left knee; 238—cover for left knee; 239—left knee; 240—torsion spring for left leg; 241—shaft for torsion spring for left leg; 242—upper cover for left knee; 243—trim for left leg; 244—seventh cross recessed round head self-tapping screw; 245—second cross recessed round head flange bolt; 246—fourth U-shaped part for left leg; 247—inside of left leg; 248—first U-shaped part for left leg; 249—eighth cross recessed round head self-tapping screw; 250—second U-shaped part for left leg; 251—sixth U-shaped part for left leg; 252—outer of left leg; 253—third U-shaped part for left leg; 254—fifth U-shaped part for left leg; 255—second U-shaped part on cover for left knee; 256—third fixing plate for left leg; 257—second steering gear for left leg; 258—wheel at rear left; 259—tire at rear left; 260—second cross recessed round head flange self-tapping screw; 261—first U-shaped part for left foot; 262—second U-shaped part for left foot; 263—shaft for left foot; 264—second fixing plate for left leg; 265—circlip for left leg; 266—first fixing plate for left leg.

DETAILED DESCRIPTION OF THE EMBODIMENTS

Figure 2:
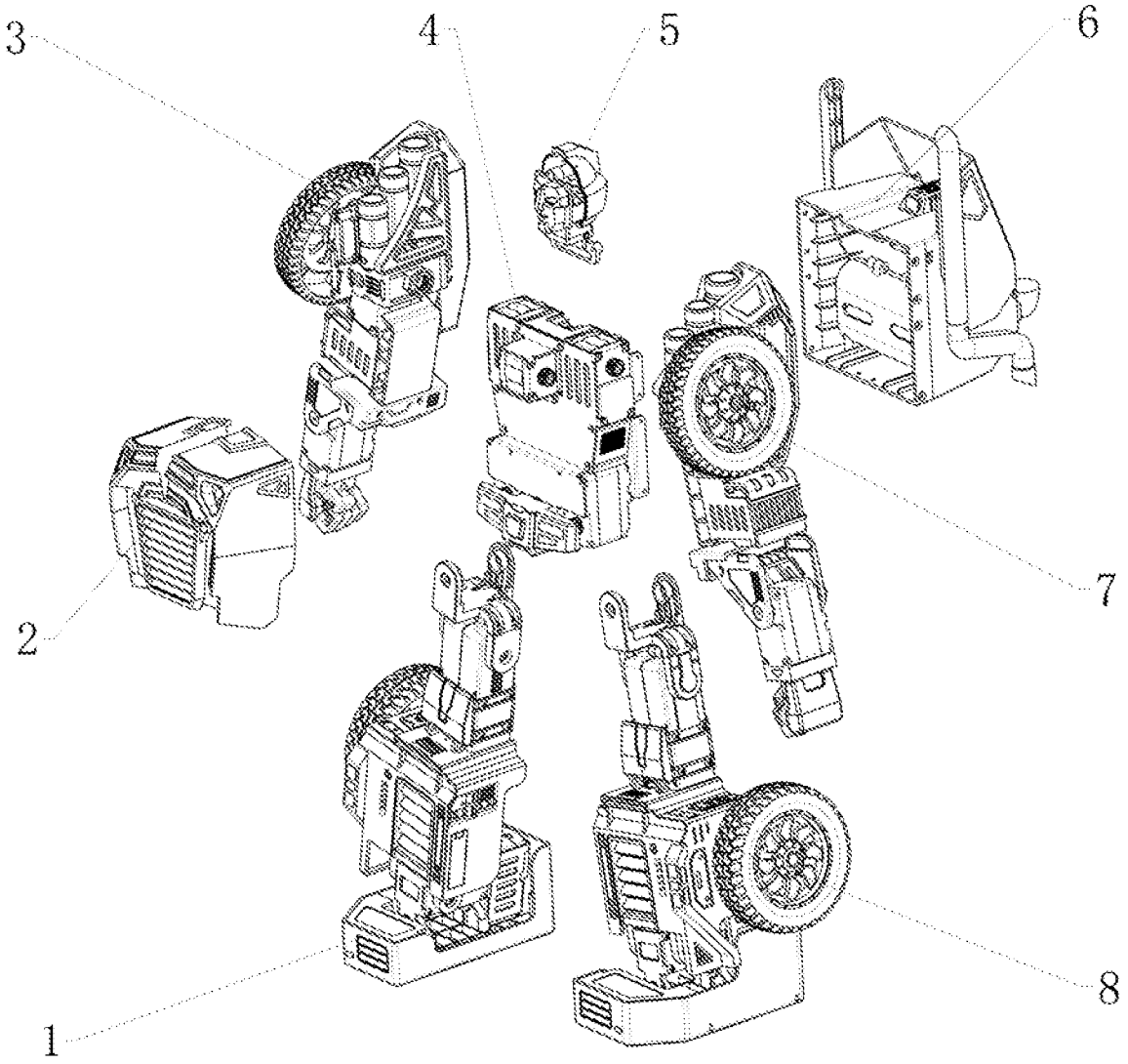
FIG. 2 is an exploded view of the transformable robot shown in FIG. 1.
Figure 3:
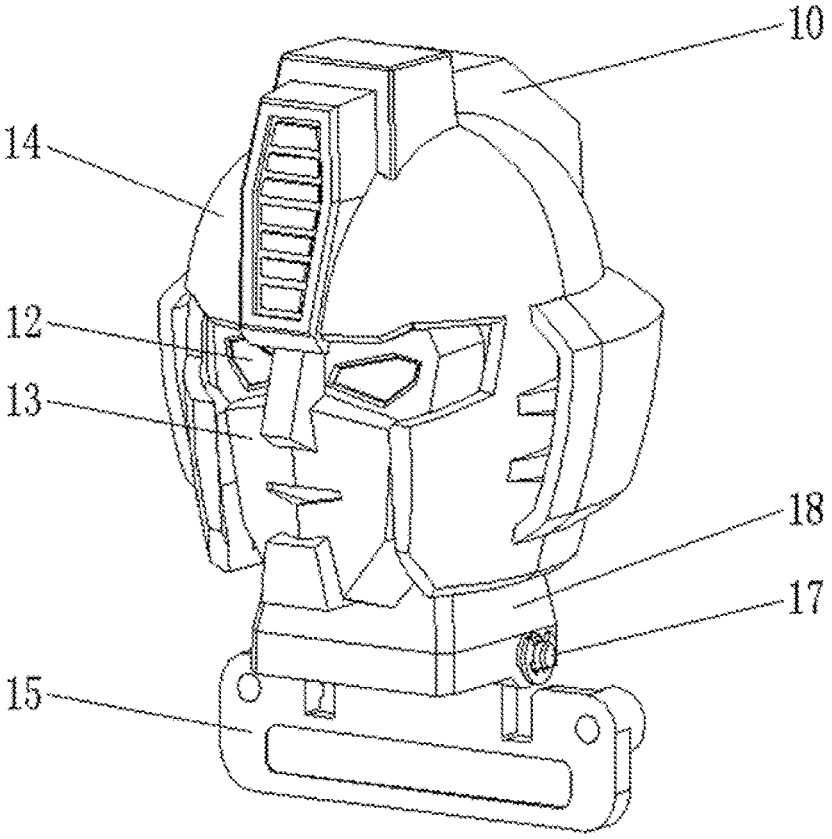
FIG. 3 is a perspective view of the head of the transformable robot shown in FIG. 1.
Figure 4:
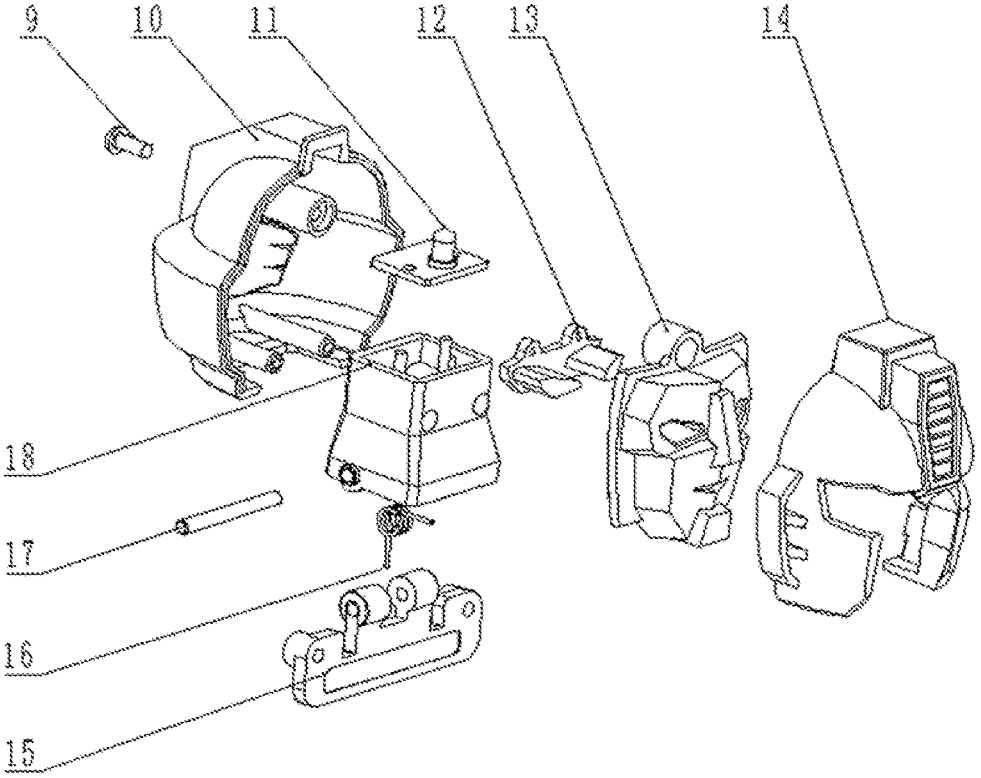
FIG. 4 is an exploded view of the head of the transformable robot shown in FIG. 1.
Figure 5:
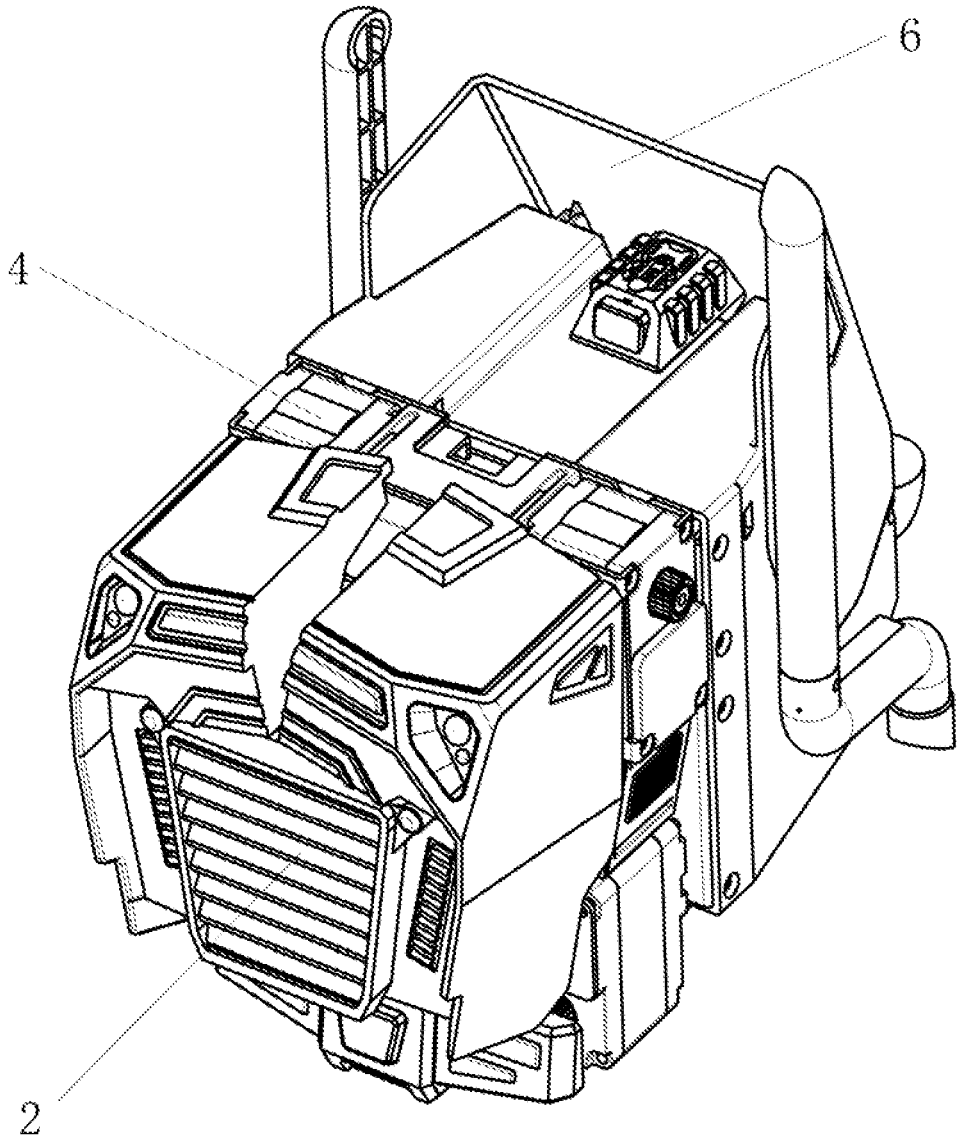
FIG. 5 is a perspective view of the car head, car body and carriage of the transformable robot shown in FIG. 1.
Figure 6:
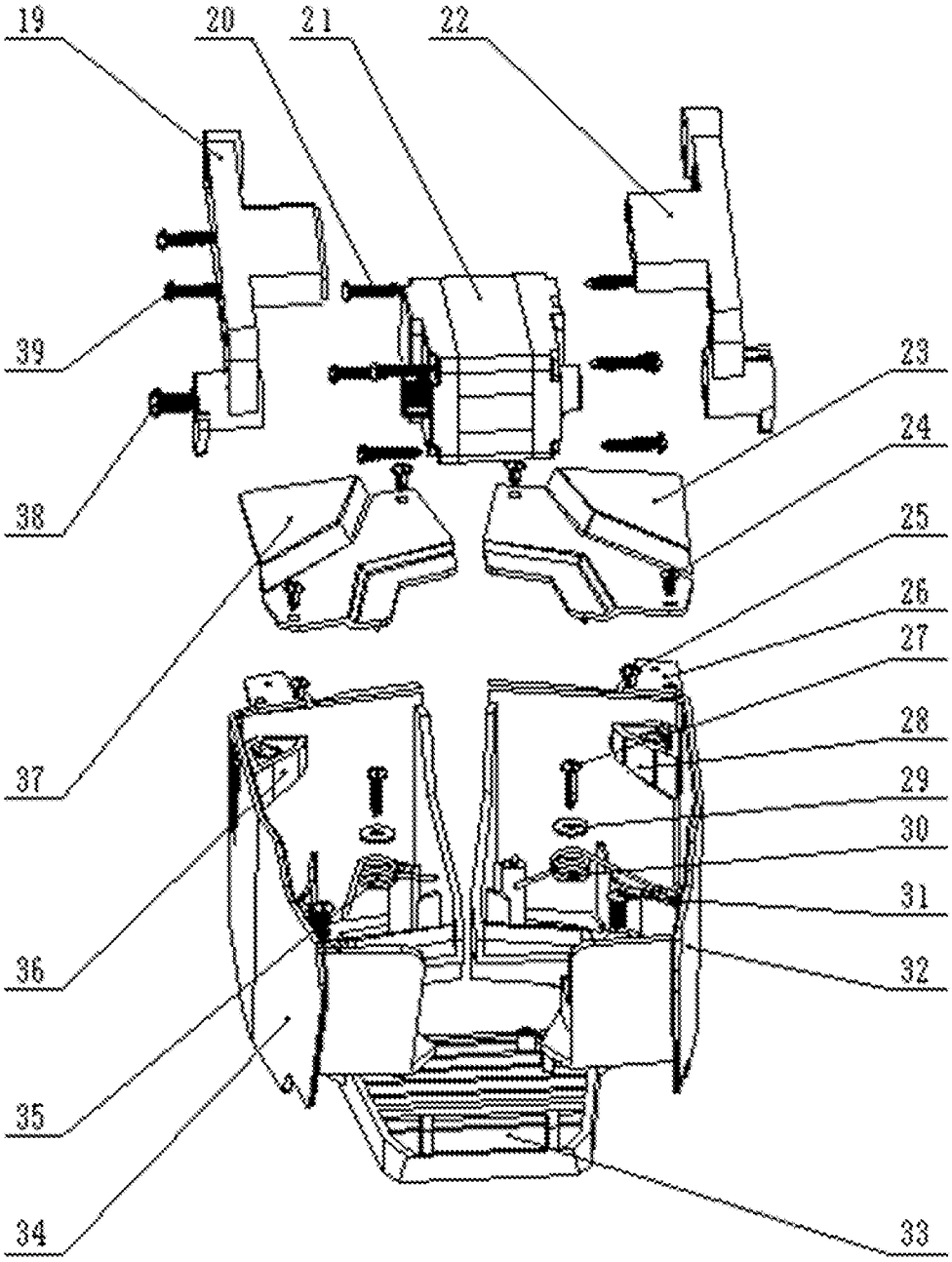
FIG. 6 is an exploded view of the car head of the transformable robot shown in FIG. 1.
Figure 7:
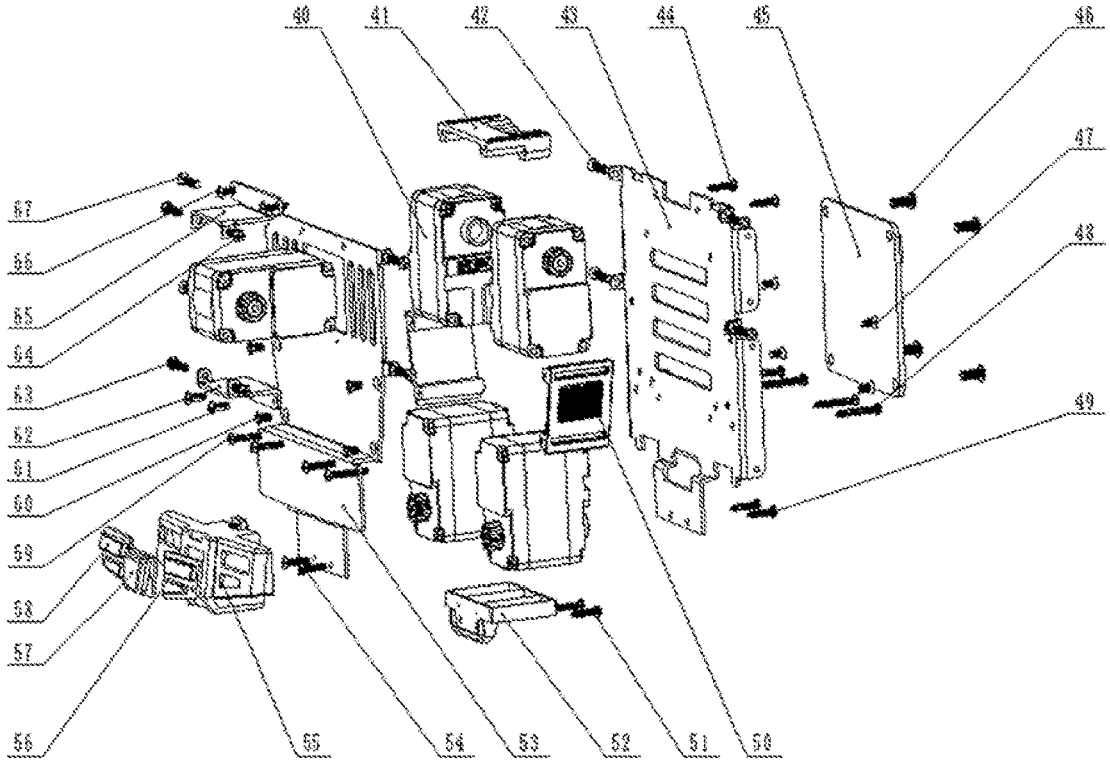
FIG. 7 is an exploded view of the car body of the transformable robot shown in FIG. 1.
Figure 8:
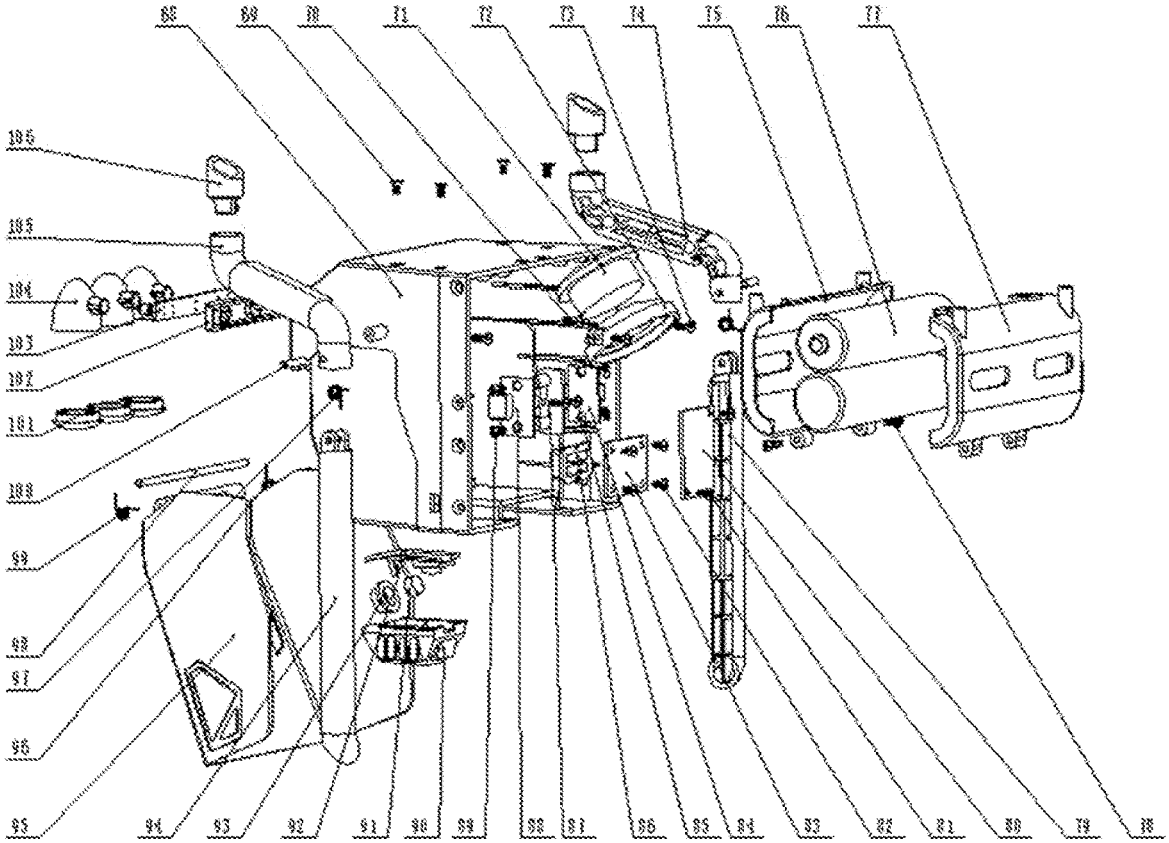
FIG. 8 is an exploded view of the carriage of the transformable robot shown in FIG. 1.
Figure 9:
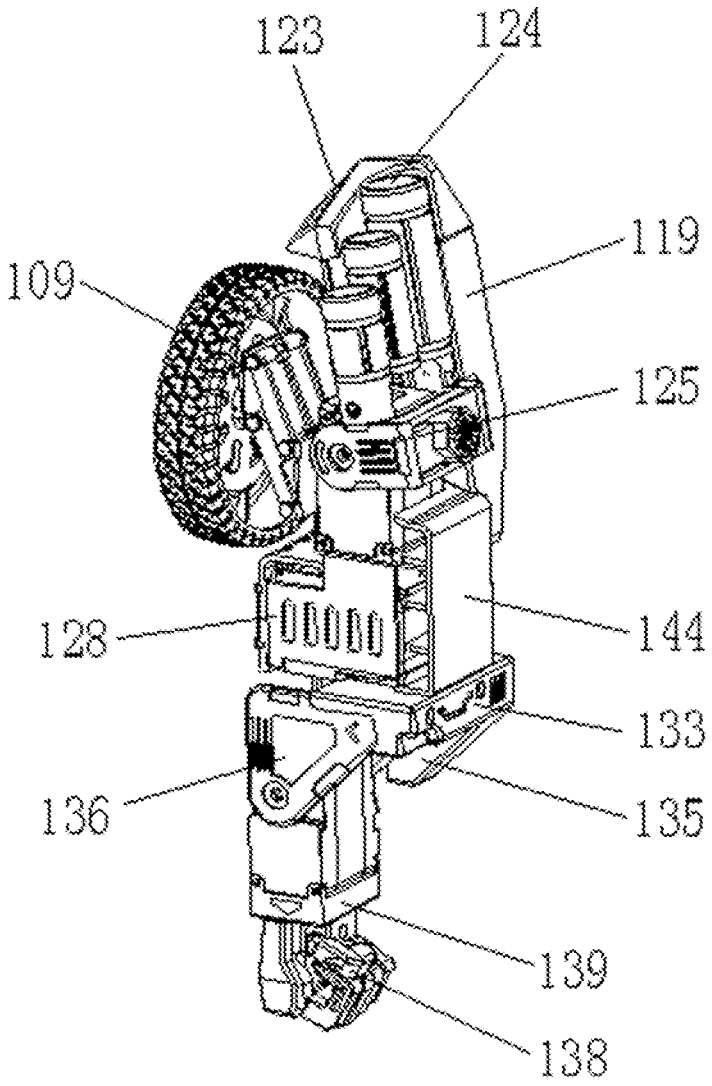
FIG. 9 is a perspective view of the right arm of the transformable robot shown in FIG. 1.
Figure 10:
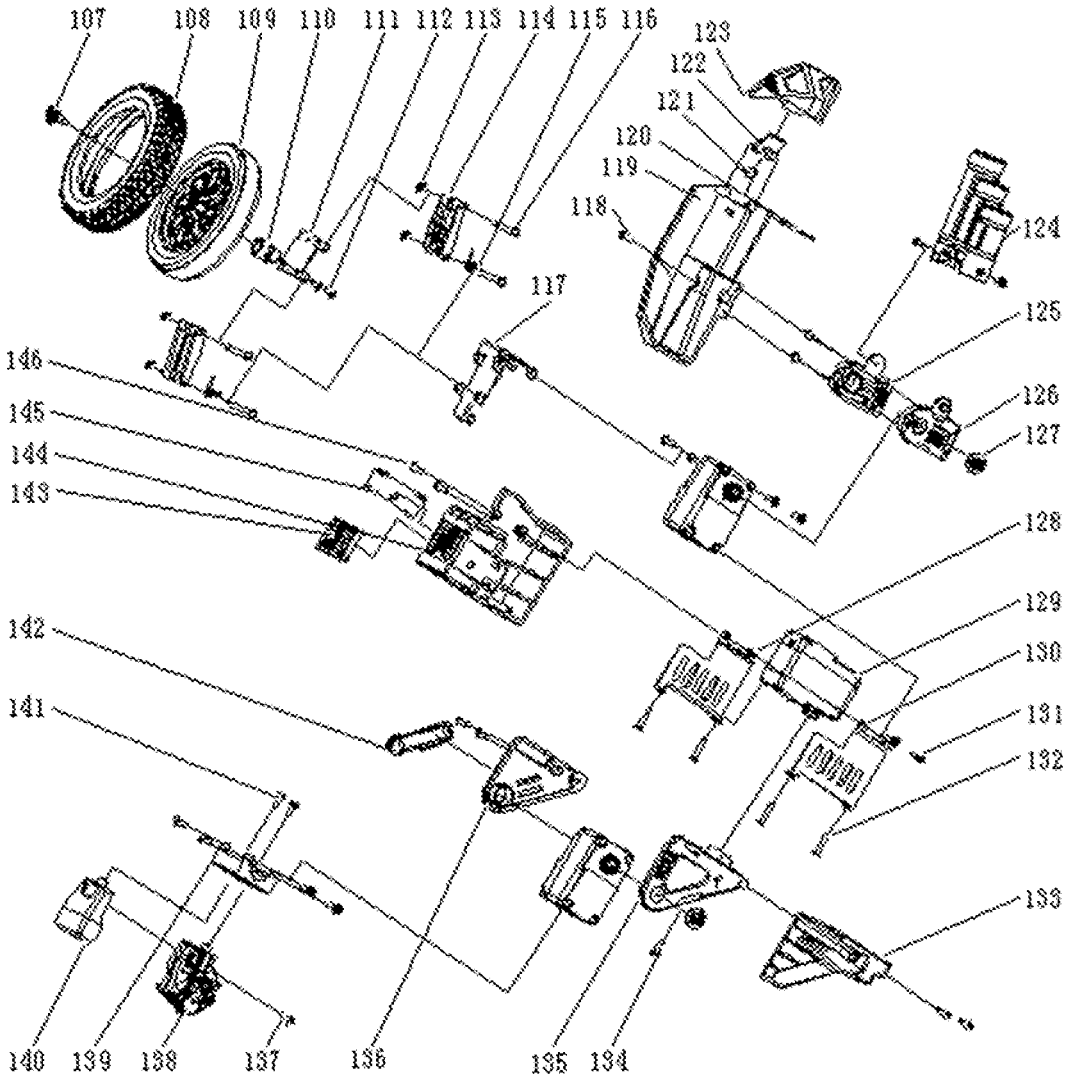
FIG. 10 is an exploded view of the right arm of the transformable robot shown in FIG. 1.
Figure 11:
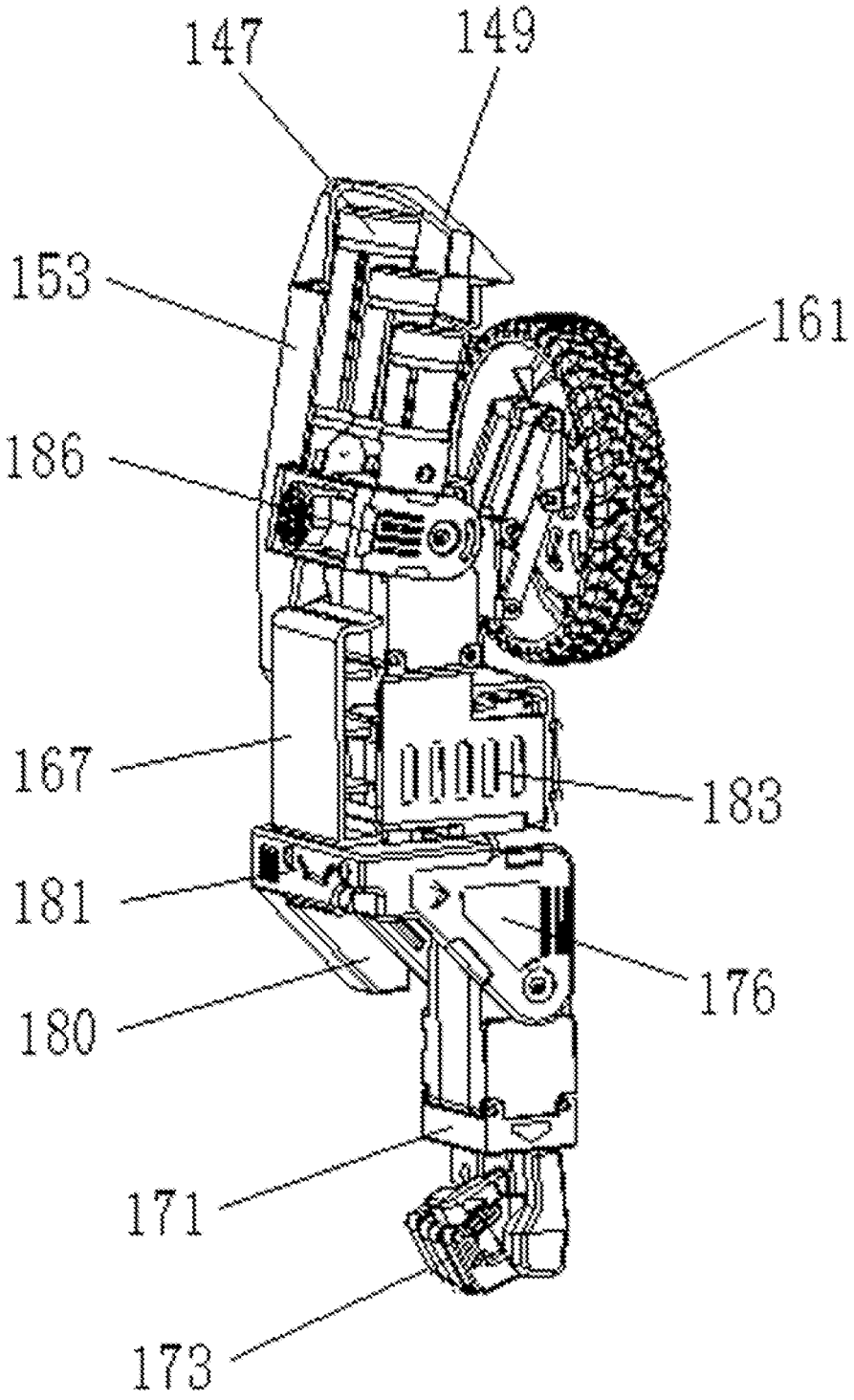
FIG. 11 is a perspective view of the left arm of the transformable robot shown in FIG. 1.
Figure 12:
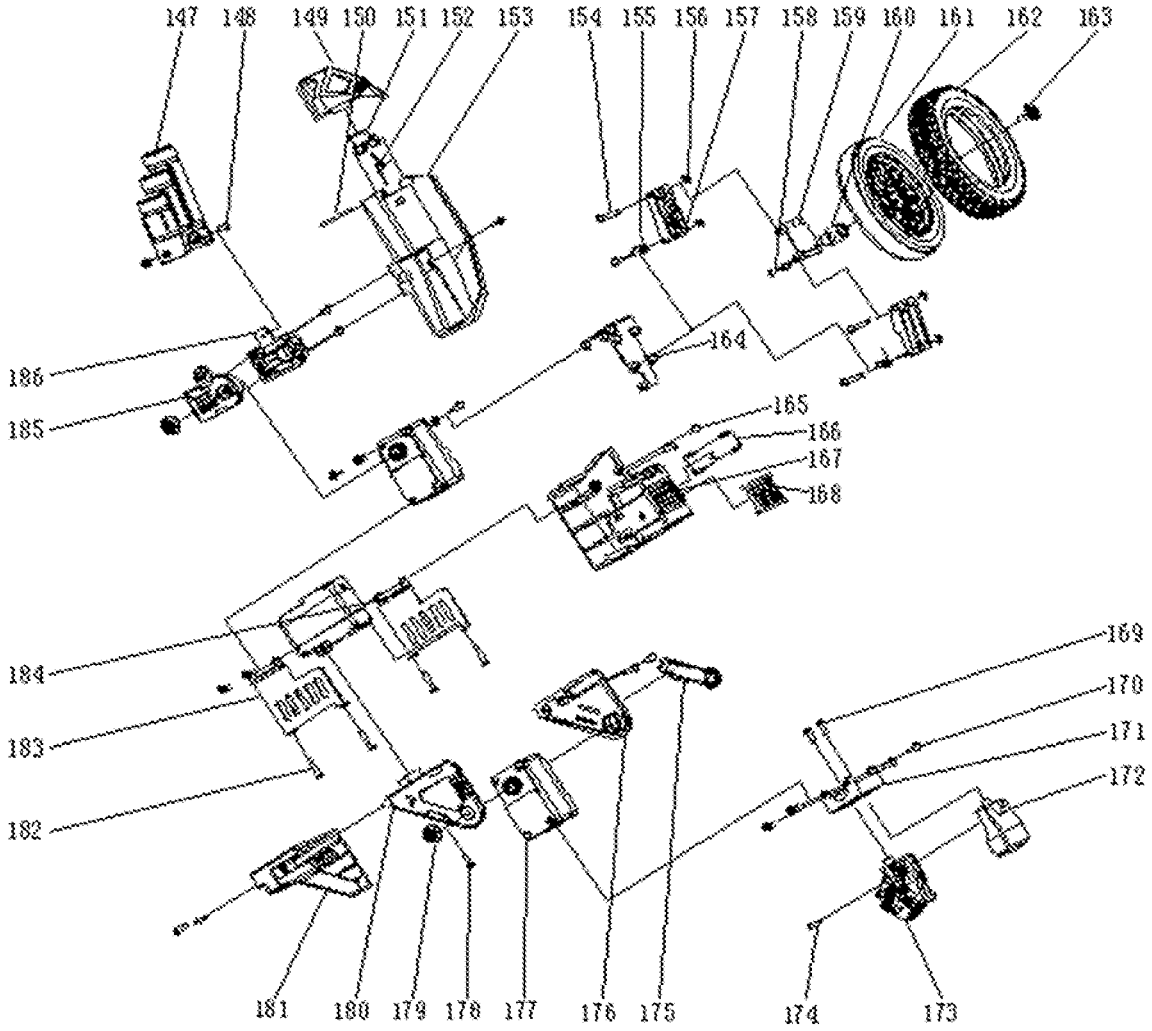
FIG. 12 is an exploded view of the left arm of the transformable robot shown in FIG. 1.
Figure 13:
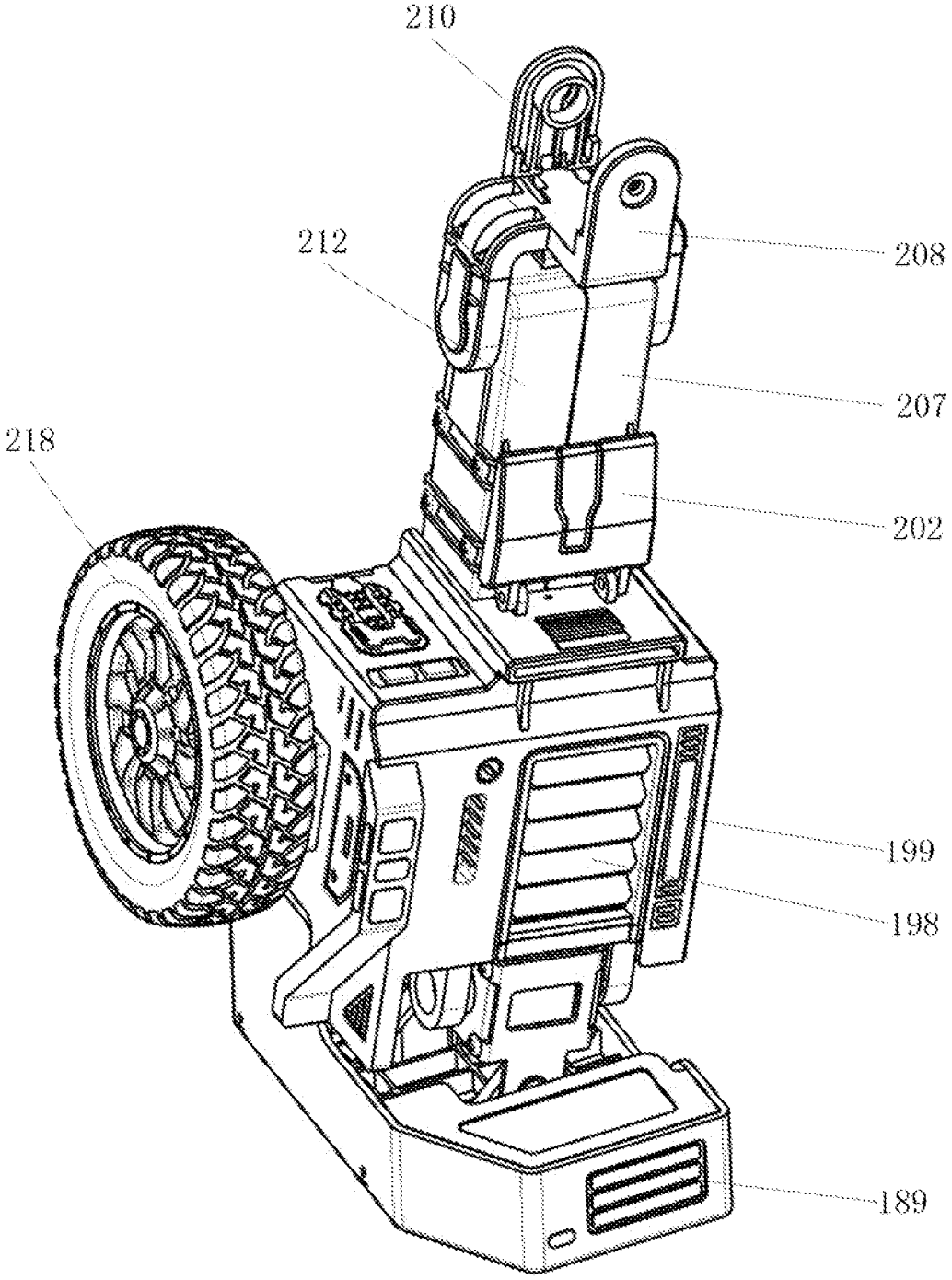
FIG. 13 is a perspective view of the right leg of the transformable robot shown in FIG. 1.
Figure 14:
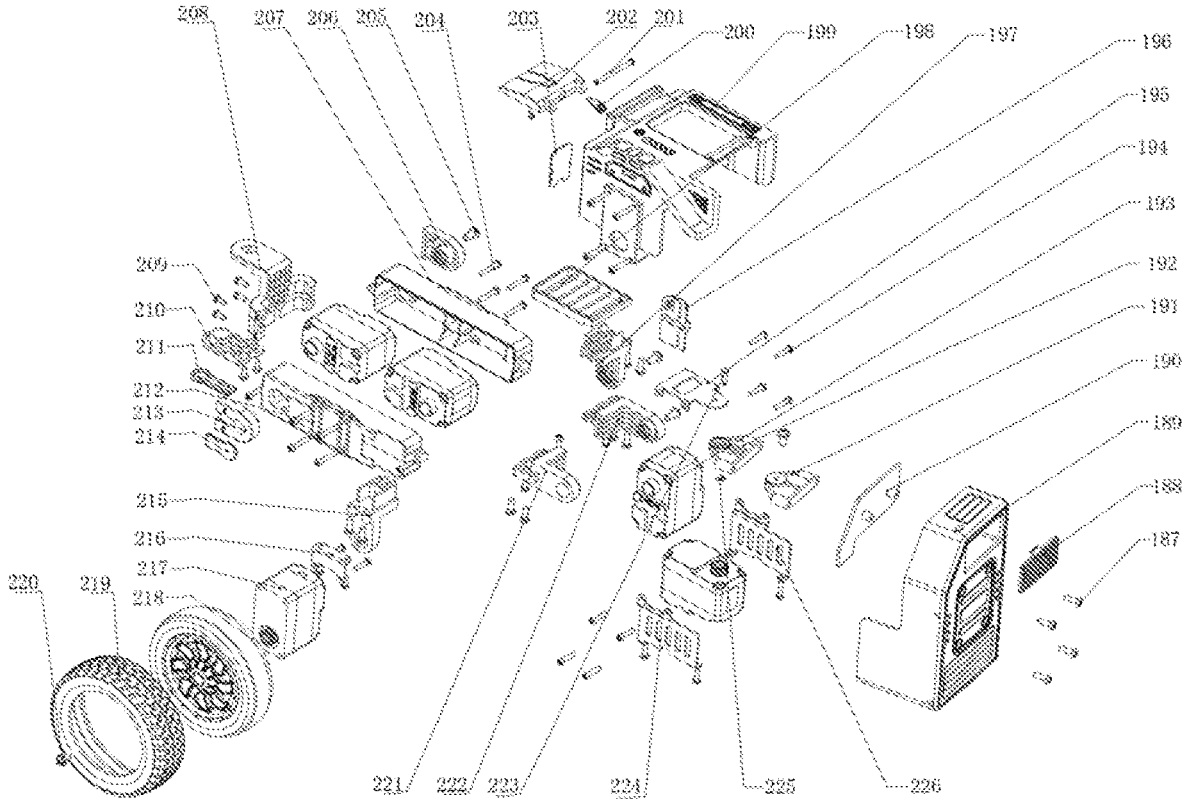
FIG. 14 is an exploded view of the right leg of the transformable robot shown in FIG. 1.
Figure 15:
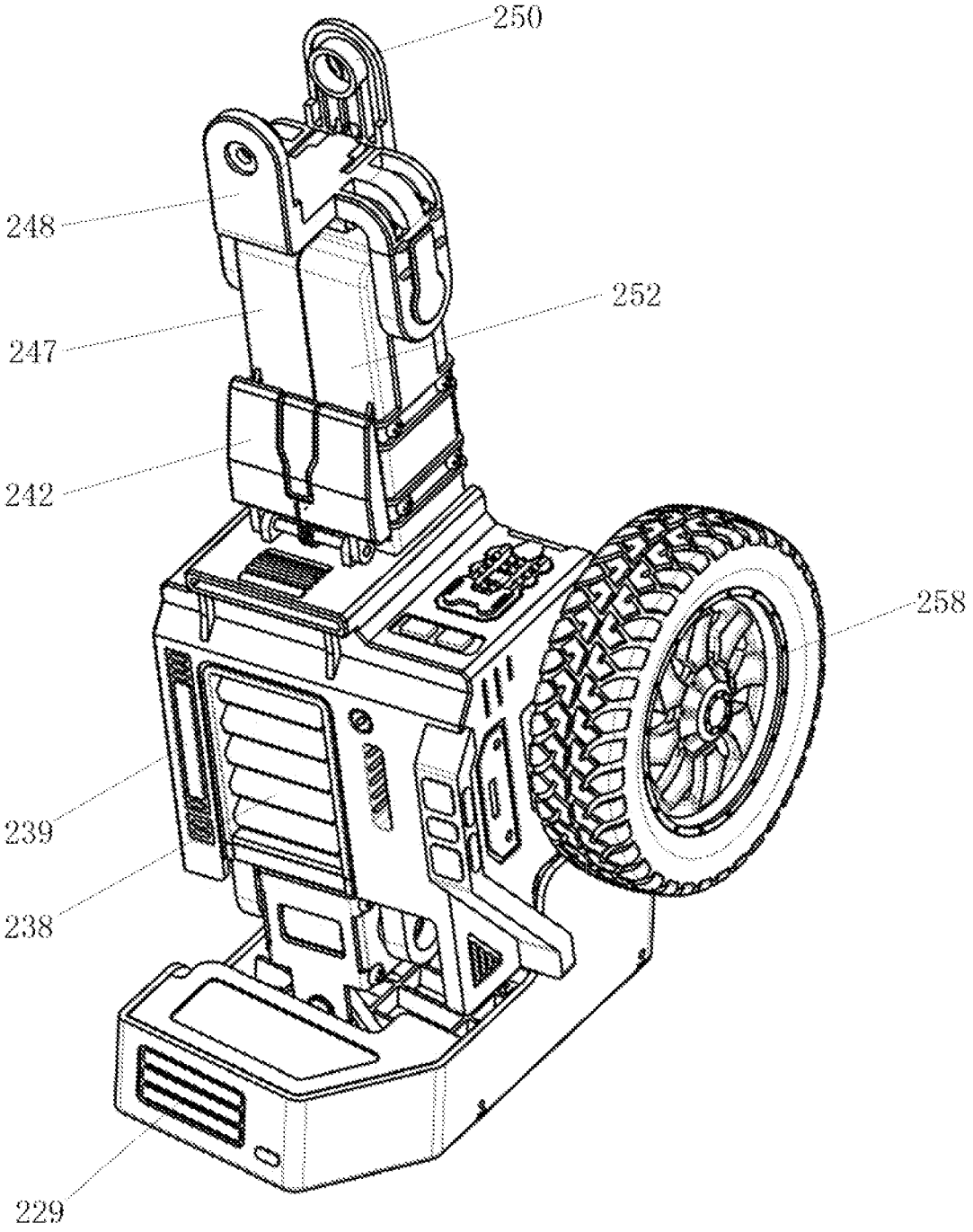
FIG. 15 is a perspective view of the left leg of the transformable robot shown in FIG. 1.
Figure 16:
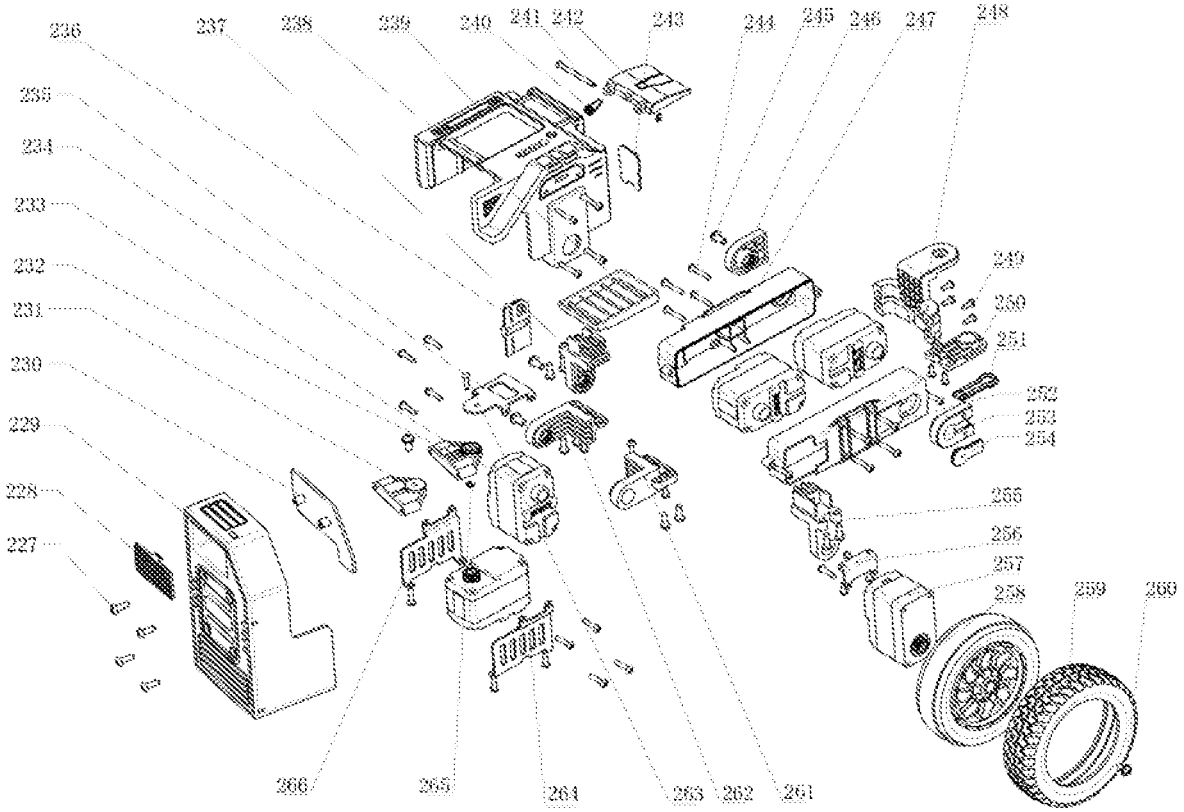
FIG. 16 is an exploded view of the left leg of the transformable robot shown in FIG. 1.

In order to understand the invention better, the preferred embodiment of the present invention is elaborated in accordance with FIG. 1-FIG. 16.

The transformable robot comprises the car body 4. Under the car body 4, the right leg 1 and the left leg 8 of the robot are equipped side by side. The right arm 3 and the left arm 7 are located respectively on the right side and the left side of the upper part of the car body 4. The car head 2 is set in the front of the car body 4, the carriage 6 is set in on the back of the car body 4, and the head 5 is set on the top of the car body 4. The right leg 1, the left leg 8, the right arm 3 and the left arm 7 are rotatablely installed on the car body 4 respectively.

The head 5 comprises the back part of the head 10, the eyes 12, the face 13, the front part of the head 14, the neck 18 and the supporting frame for head 15, the eyes 12 are set inside the face 13, the face 13 is set inside the back part of the head 10 by the first round head self-tapping screw 9, the front part of the head 14 is set on the outside of the face 13, the neck 18 is set at the bottom of the head 5, the supporting frame for head 15 is installed at the bottom of the neck 18 by the rotating shaft 17 and the torsion spring 16 which is assembled on the rotating shaft 17, and the PCB 11 is set on the upper part of the neck 18.

The car head 2 comprises the first frame in car head 19, two steering gears with metal teeth for car head 21, the second frame in car head 22, the right cover for grille 23, the PCB for head light 26, the right head light 28, the right torsion spring for car head 30, the right car head 32, the grille 33, the left car head 34, the left torsion spring for car head 35, the left head light 36, the left cover for grille 37. The left car head 34 is connected with the grille 33 by a fifth round head self-tapping screw 27 and a first flange self-tapping screw 31, and a shim 29 and the left torsion spring for car head 35 is assembled on the fifth round head self-tapping screw 27. At the same time, the right car head 32 is connected with the grille 33 by another fifth round head self-tapping screw 27 and another first flange self-tapping screw 31, and another shim 29 and the right torsion spring for car head 30 are assembled on the another fifth round head self-tapping screw 27. The left head light 36 is set inside of the left car head 34, and the right head light 28 is set inside of the right car head 32. Two printed circuit boards for head light 26 are connected with the left car head 34 and the right car head 32 respectively. In the left car head 34 and the right car head 32, the first frame in car head, two steering gears with metal teeth for car head 21, and the second frame in car head 22 are internally equipped. The left cover for grille 37 is set at the back of the left car head 34, and the right cover for grille 23 is set at the back of the right car head 32.

The car body 4 comprises the first steering gear for car body 40, the second steering gear for car body, the third steering gear for car body, the fourth steering gear for car body, the fifth steering gear for car body, the bottom for car head 41, the sheet metal parts at the back of the car body 43, the PCB for control 45, the armpit 50, the fifth part of waist 52, the sheet metal parts at the front of the car body 53, the first part of waist 55, the second part of waist 56, the third part of waist 57, the fourth part of waist 58, the sheet metal parts under the steering gear for grille 62, the sheet metal parts above the steering gear for grille 65. The fifth steering gear for car body is equipped between the sheet metal parts under the steering gear for grille 62 and the sheet metal parts above the steering gear for grille. Between the sheet metal parts at the front of the car body 53 and the sheet metal parts at the back of the car body 43, the bottom for car head 41, the armpit 50, the first steering gear for car body 40, the second steering gear for car body, the third steering gear for car body, the fourth steering gear for car body and the fifth part of waist 52 are set. The first steering gear for car body 40 and the second steering gear for car body are horizontally installed on the upper part of the car body 4 side by side, while the third steering gear for car body and the fourth steering gear for car body are horizontally installed on the lower part of the car body 4 side by side. The PCB for control 45 is installed on the side of the sheet metal parts at the back of the car body 43, and the side is further from the sheet metal parts at the front of the car body 53.

The carriage 6 comprises the roof 68, the horn 71, the acoustic chamber 72, the exhaust at the rear right 74, the battery box 75, two batteries 76, the cover for the battery box 77, the exhaust at the front right 79, the PCB for microphone 80, the PCB for switch 83, the charging interface 84, the buttons 86, the small size supporting frame 87, the USB interface 88, the microphone box 90, the microphone 91, the cover for the microphone box 92, the rubber sleeve 93, the exhaust at the front left 94, the window 95, the right torsion spring for window 96, the torsion spring for exhaust 97, the first shaft for the carriage 98, the left torsion spring for window 99, the second shaft for the carriage 100, the lampshade for roof light 101, the supporting frame for roof light 102, the PCB for roof light 103, the roof lights 104, the exhaust at the rear left 105, the tailpipe 106. The supporting frame for roof light 102 is installed in the rear of the roof 68. The PCB for roof light 103, the roof lights 104, the lampshade for roof light 101 are successively equipped on the supporting frame for roof light 102. The lower part of the roof 68 is connected with the window 95 using the first shaft for the carriage 98, the left torsion spring for window 99 and the right torsion spring for window 96, wherein the left torsion spring for window 99 and the right torsion spring for window 96 are assembled on the first shaft for the carriage 98. The horn 71, the acoustic chamber 72, the battery box 75, the two batteries 76, the cover for the battery box 77, the PCB for microphone 80, the PCB for switch 83, the charging interface 84, the buttons 86, the small size supporting frame 87, the USB interface 88 and the microphone box 90 are set at the front of the roof 68. The microphone box 90, the microphone 91, the cover for the microphone box 92 and the rubber sleeve 93 are set at the bottom of the roof 68.

The right arm 3 comprises the tire at front right 108, the wheel at front right 109, the fixing frame for the wheel at front right 110, the supporting frame for the wheel at front right 111, the first circlip 113, the frame for the wheel at front right 114, the first spring 115, the shaft for the wheel at front right 116, the hang frame for the right arm 117, the second cover for the right arm 119, the shaft for right upper arm 120, the second spring 121, the mounting part for spring on the right arm 122, the first cover for the right arm 123, the barrel on the right arm 124, the second U-shaped part on right shoulder 125, the first U-shaped part on right shoulder 126, the forward frame for steering gear at elbow of right arm 128, the steering gear with metal teeth for right arm 129, the backward frame for steering gear at elbow of right arm 130, the third part of elbow of right arm 133, the first part of elbow of right arm 135, the second part of elbow of right arm 136, the right palm 138, the right wrist 139, the back of right hand 140, the clip for wiring on right arm 142, the ladder on right arm 143, the elbow of right arm 144 and the trim on right arm 145. The hang frame for the right arm 117 is connected with the frame for the wheel at front right 114, while the frame for the wheel at front right 114 is connected with the supporting frame for the wheel at front right 111. The fixing frame for the wheel at front right 110 is installed on the supporting frame for the wheel at front right 111. The tire at front right 108 and the wheel at front right 109 are equipped on the fixing frame for the wheel at front right 110. The first cover for the right arm 123, the barrel on the right arm 124, the second U-shaped part on right shoulder 125, the first U-shaped part on right shoulder 126, the shaft for right upper arm 120, the second spring 121 and the mounting part for spring on the right arm 122 are equipped on the second cover for the right arm 119. The steering gear with metal teeth for right arm 129 is set between the forward frame for steering gear at elbow of right arm 128 and the backward frame for steering gear at elbow of right arm 130. The third part of elbow of right arm 133, the first part of elbow of right arm 135 and the second part of elbow of right arm 136 are assembled together and the upper part thereof is connected with the elbow of right arm 144, the lower part thereof is connected with the right wrist 139, while the right wrist 139 is connected with the right palm 138.

The left arm 7 comprises the steering gear on the top of the left arm, the steering gear on the middle of the left arm, the tire at front left 162, the wheel at front left 161, the fixing frame for the wheel at front left 160, the supporting frame for the wheel at front left 159, the second circlip 156, the frame for the wheel at front left 157, the fifth spring 155, the shaft for the wheel at front left 154, the hang frame for the left arm 164, the second cover for the left arm 153, the shaft for left upper arm 150, the sixth spring 152, the mounting part for spring on the left arm 151, the first cover for the left arm 149, the first cover for the left arm 147, the second U-shaped part on left shoulder 186, the first U-shaped part on left shoulder 185, the forward frame for steering gear at elbow of left arm 183, the steering gear with metal teeth for left arm 177, the backward frame for steering gear at elbow of left arm 184, the third part of elbow of left arm 181, the first part of elbow of left arm 180, the second part of elbow of left arm 176, the left palm 173, the left wrist 171, the back of left hand 172, the clip for wiring on left arm 175, the ladder on left arm 168, the elbow of left arm 167, the trim on left arm 166. The hang frame for the left arm 164 is connected with the frame for the wheel at front left 157, while the frame for the wheel at front left 157 is connected with the supporting frame for the wheel at front left 159. The fixing frame for the wheel at front left 160 is installed on the supporting frame for the wheel at front left 159. The tire at front left 162 and the wheel at front left 161 are equipped on the fixing frame for the wheel at front left 160. The first cover for the left arm 149, the first cover for the left arm 147, the second U-shaped part on left shoulder 186, the first U-shaped part on left shoulder 185, the shaft for left upper arm 150, the sixth spring 152 and the mounting part for spring on the left arm 151 are equipped on the second cover for the left arm 153. The steering gear with metal teeth for left arm 177 is set between the forward frame for steering gear at elbow of left arm 183 and the backward frame for steering gear at elbow of left arm 184. The third part of elbow of left arm 181, the first part of elbow of left arm 180 and the second part of elbow of left arm 176 are assembled together and the upper part thereof is connected with the elbow of left arm 167, the lower part thereof is connected with the left wrist 171, while the left wrist 171 is connected with the left palm 173. The steering gear on the top of the left arm is set on the top of the left arm 7, while the steering gear on the middle of the left arm is set on the middle of the left arm 7.

The right leg 1 comprises the sole of right foot 188, the right foot 189, the instep of right foot 190, the first frame for right foot 191, the second frame for right foot 192, the first steering gear for right leg 193, the fourth fixing plate for right leg 195, the trim on right knee 196, the first U-shaped part on cover for right knee 197, the cover for right knee 198, the right knee 199, the torsion spring for right leg 200, the shaft for torsion spring for right leg 201, the upper cover for right knee 202, the trim for right leg 203, the fourth U-shaped part for right leg 206, the inside of right leg 207, the first U-shaped part for right leg 208, the second U-shaped part for right leg 210, the sixth U-shaped part for right leg 211, the outer of right leg 212, the third U-shaped part for right leg 213, the fifth U-shaped part for right leg 214, the second U-shaped part on cover for right knee 215, the third fixing plate for right leg 216, the second steering gear for right leg 217, the third steering gear for right leg, the fourth steering gear for right leg, the fifth steering gear for right leg, the wheel at rear right 218, the tire at rear right 219, the first U-shaped part for right foot 221, the second U-shaped part for right foot 222, the shaft for right foot 223, the second fixing plate for right leg 224, the circlip for right leg 225, the first fixing plate for right leg 226. The sole of right foot 188 is installed at the bottom of the right foot 189, and the instep of right foot 190 is installed on the top of the right foot 189, the first frame for right foot 191, the second frame for right foot 192, the second fixing plate for right leg 224 and the first fixing plate for right leg 226 are installed on the top of the instep of right foot 190. The third steering gear for right leg is set between the second fixing plate for right leg 224 and the first fixing plate for right leg 226. The first steering gear for right leg 193 is equipped in the space which is formed by the first frame for right foot 191, the second frame for right foot 192, the first U-shaped part for right foot 221 and the second U-shaped part for right foot 222. The upper part of the right knee 199 is connected with the upper cover for right knee 202 by the torsion spring for right leg 200 and the shaft for torsion spring for right leg 201. The cover for right knee 198 is equipped at front of the right knee 199, the inside of right leg 207 is equipped on the outside of the right knee 199, the fourth U-shaped part for right leg 206 is equipped on the upper part of the inside of right leg 207. The inside of right leg 207 is set opposite to the outer of right leg 212, and the fourth steering gear for right leg and the fifth steering gear for right leg are installed between the inside of right leg 207 and the outer of right leg 212 side by side. The third U-shaped part for right leg 213 is installed on the outside of the outer of right leg 212, the fifth U-shaped part for right leg 214 is installed on the outside of the third U-shaped part for right leg 213, and the first U-shaped part for right leg 208 and the second U-shaped part for right leg 210 are installed on the back of the inside of right leg 207 and the outer of right leg 212. The sixth U-shaped part for right leg 211 is installed on the outside of the second U-shaped part for right leg 210. The second U-shaped part on cover for right knee 215, the third fixing plate for right leg 216, the second steering gear for right leg 217, the wheel at rear right 218 and the tire at rear right 219 are successively equipped on the lower part of the outer of right leg 212.

The left leg 8 comprises the sole of left foot 228, the left foot 229, the instep of left foot 230, the first frame for left foot 231, the second frame for left foot 232, the first steering gear for left leg 233, the fourth fixing plate for left leg 235, the trim on left knee 236, the first U-shaped part on cover for left knee 237, the cover for left knee 238, the left knee 239, the torsion spring for left leg 240, the shaft for torsion spring for left leg 241, the upper cover for left knee 242, the trim for left leg 243, the fourth U-shaped part for left leg 246, the inside of left leg 247, the first U-shaped part for left leg 248, the second U-shaped part for left leg 250, the sixth U-shaped part for left leg 251, the outer of left leg 252, the third U-shaped part for left leg 253, the fifth U-shaped part for left leg 254, the second U-shaped part on cover for left knee 255, the third fixing plate for left leg 256, the second steering gear for left leg 257, the third steering gear for left leg, the fourth steering gear for left leg, the fifth steering gear for left leg, the wheel at rear left 258, the tire at rear left 259, the first U-shaped part for left foot 261, the second U-shaped part for left foot 262, the shaft for left foot 263, the second fixing plate for left leg 264, the circlip for left leg 265 and the first fixing plate for left leg 266. The third steering gear for left leg is set between the second fixing plate for left leg 264 and the first fixing plate for left leg 266. The first steering gear for left leg 233 is equipped in the space which is formed by the first frame for left foot 231, the second frame for left foot 232, the first U-shaped part for left foot 261 and the second U-shaped part for left foot 262. The upper part of the left knee 239 is connected with the upper cover for left knee 242 by the torsion spring for left leg 240 and the shaft for torsion spring for left leg 241. The cover for left knee 238 is equipped at front of the left knee 239, the inside of left leg 247 is equipped on the outside of the left knee 239, and the fourth U-shaped part for left leg 246 is equipped on the upper part of the inside of left leg 247. The inside of left leg 247 is set opposite to the outer of left leg 252, and the fourth steering gear for left leg and the fifth steering gear for left leg are installed between the inside of left leg 247 and the outer of left leg 252 side by side. The third U-shaped part for left leg 253 is installed on the outside of the outer of left leg 252, the fifth U-shaped part for left leg 254 is installed on the outside of the third U-shaped part for left leg 253, and the first U-shaped part for left leg 248 and the second U-shaped part for left leg 250 are installed on the back of the inside of left leg 247 and the outer of left leg 252. The sixth U-shaped part for left leg 251 is installed on the outside of the second U-shaped part for left leg 250. The second U-shaped part on cover for left knee 255, the third fixing plate for left leg 256, and the second steering gear for left leg 257, the wheel at rear left 258 and the tire at rear left 259 are successively equipped on the lower part of the outer of left leg 252.

The PCB means the printed circuit board, which is an important electronic component, a support for electronic components and a carrier for electrical connection of electronic components. Because it is made by electronic printing, it is called "printed" circuit board. When the PCB is applied in the electronic equipment, because its consistency of the same kind of printed board, error of manual wiring can be avoided, at the same time, the electronic components can be automatically inserted or pasted, automatically soldered and automatically detected, ensuring the quality of the electronic equipment, improving the labor productivity, reducing the cost and facilitating the maintenance.

Figure 17:
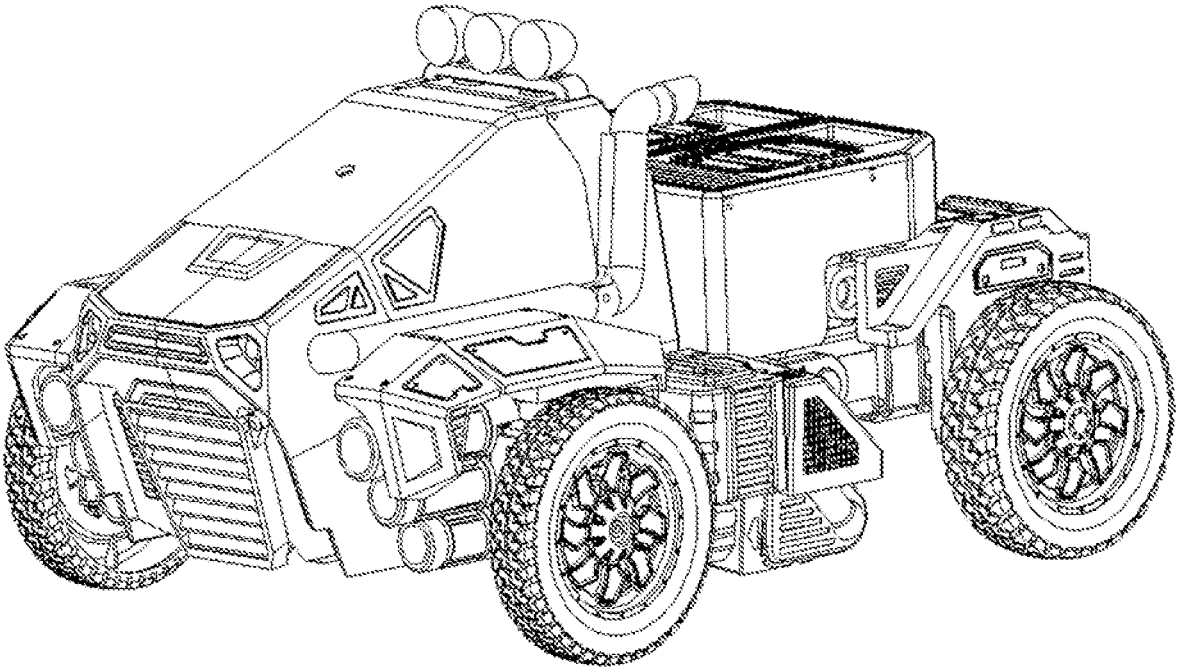
FIG. 17 is a form diagrammatic sketch for step one of the transforming method of the transformable robot according to the present invention.
Figure 18:
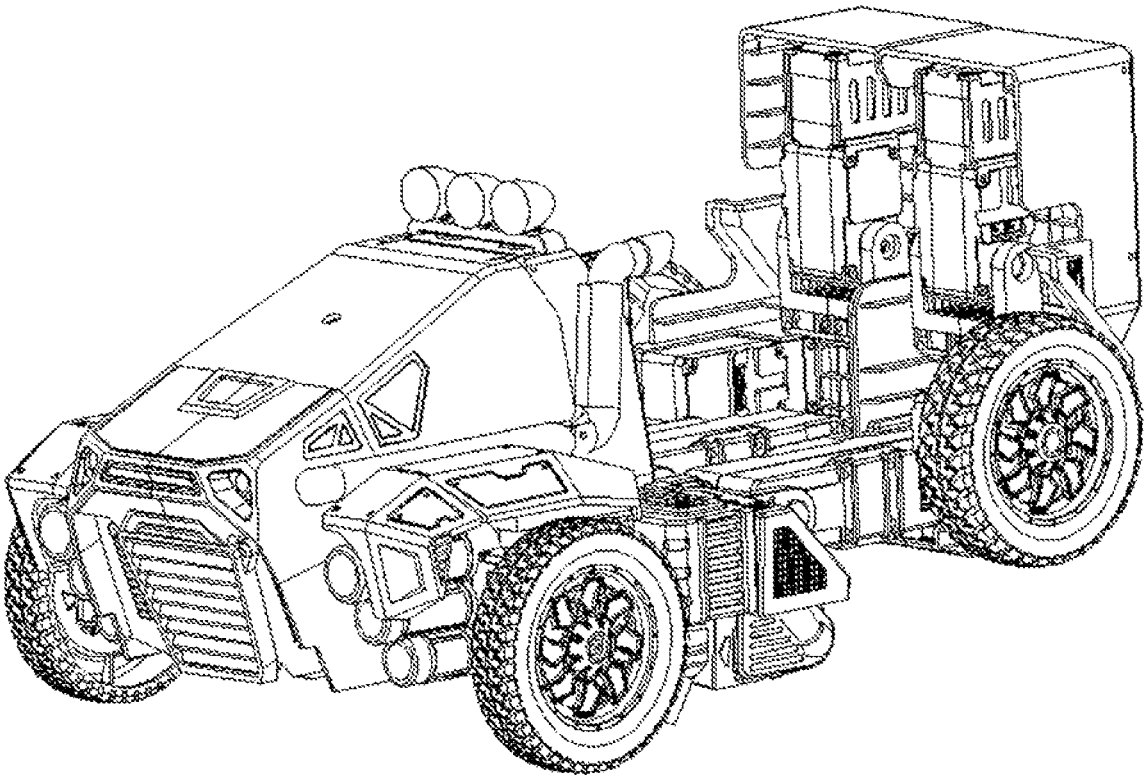
FIG. 18 is a form diagrammatic sketch for step two of the transforming method of the transformable robot according to the present invention.
Figure 19:
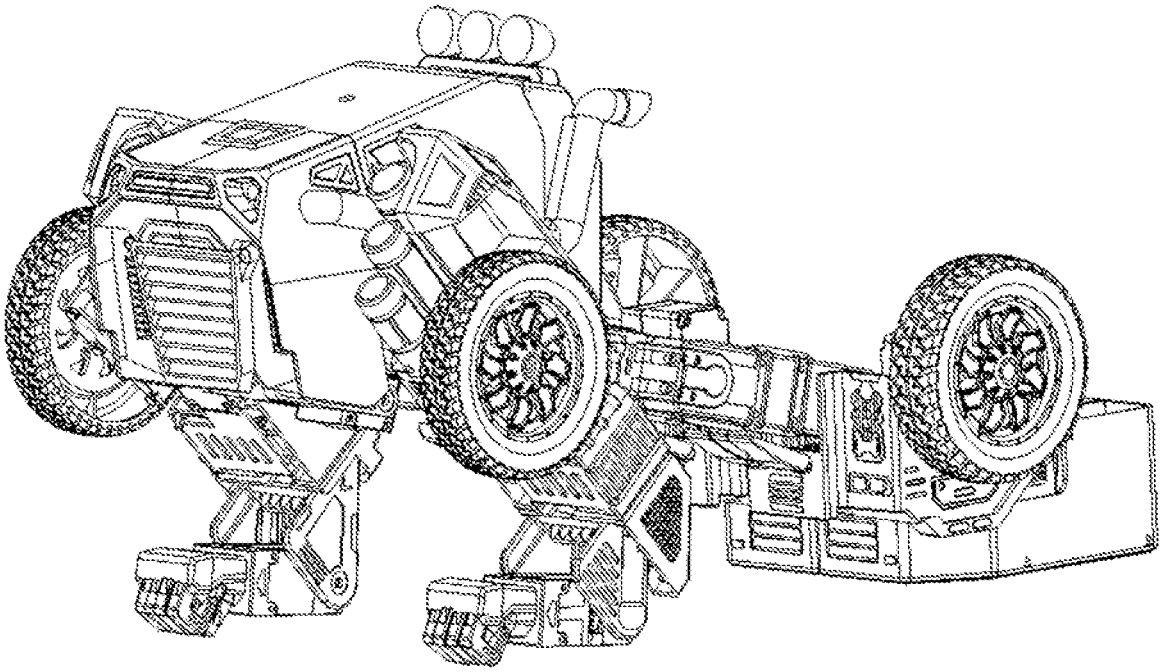
FIG. 19 is a form diagrammatic sketch for step three of the transforming method of the transformable robot according to the present invention.
Figure 20:
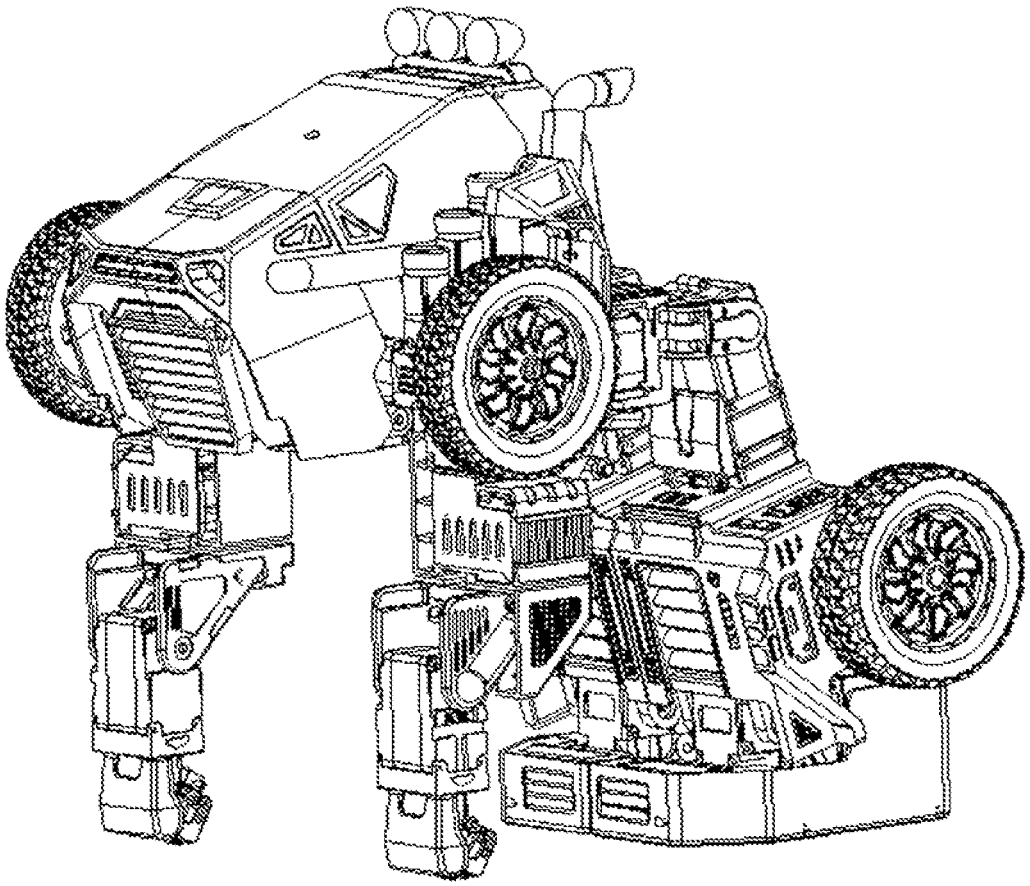
FIG. 20 is a form diagrammatic sketch for step four of the method of shape shift for the transformable robot.
Figure 21:
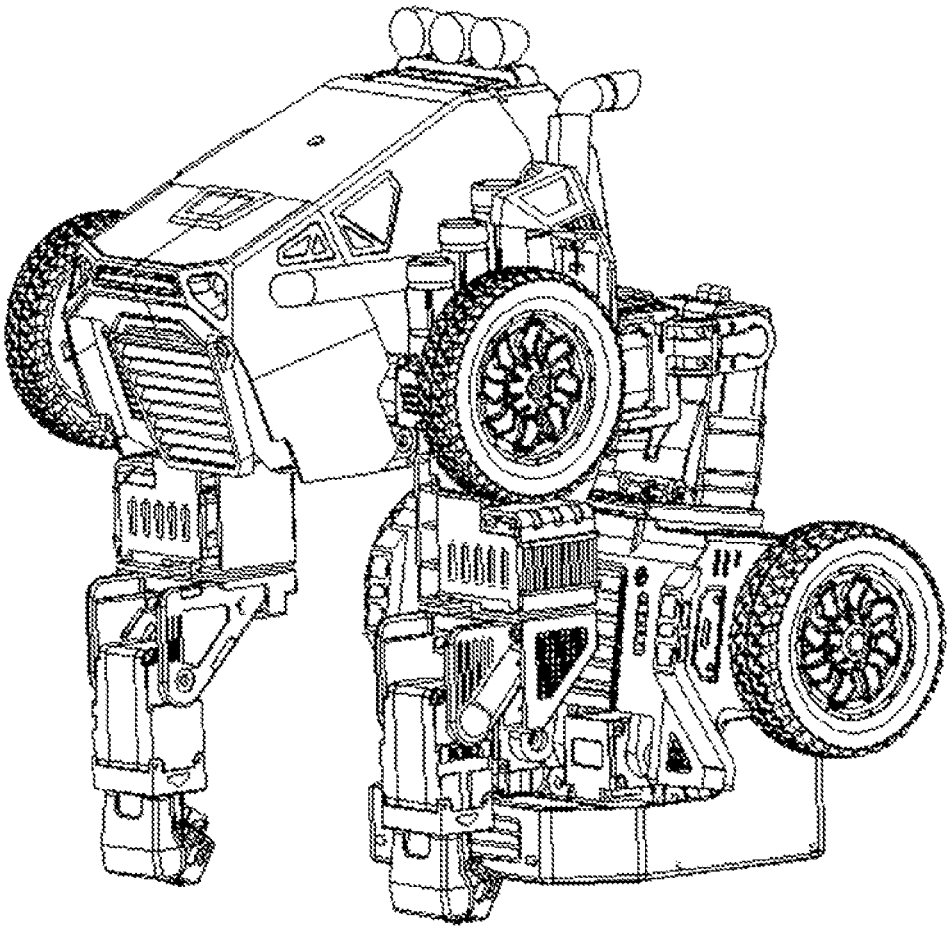
FIG. 21 is a form diagrammatic sketch for step five of the transforming method of the transformable robot according to the present invention.
Figure 22:
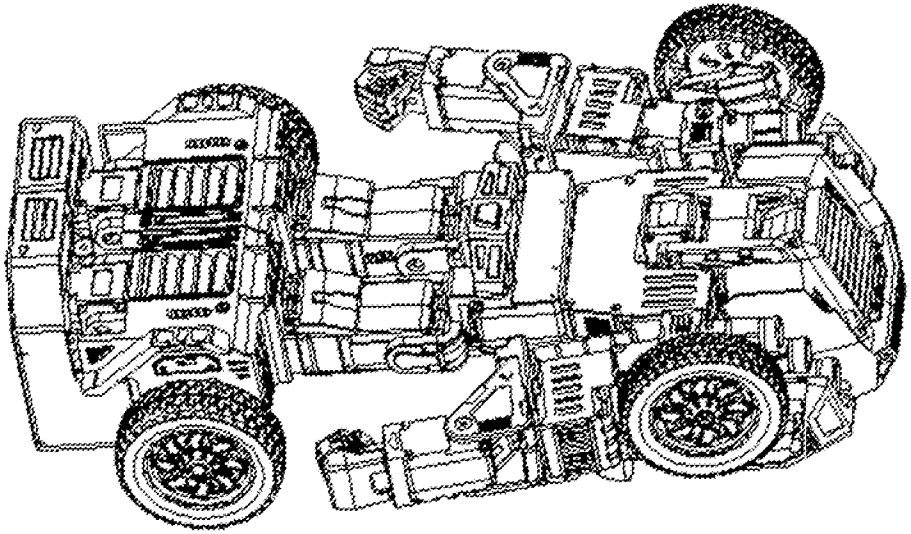
FIG. 22 is a form diagrammatic sketch for step six of the transforming method of the transformable robot according to the present invention.
Figure 23:
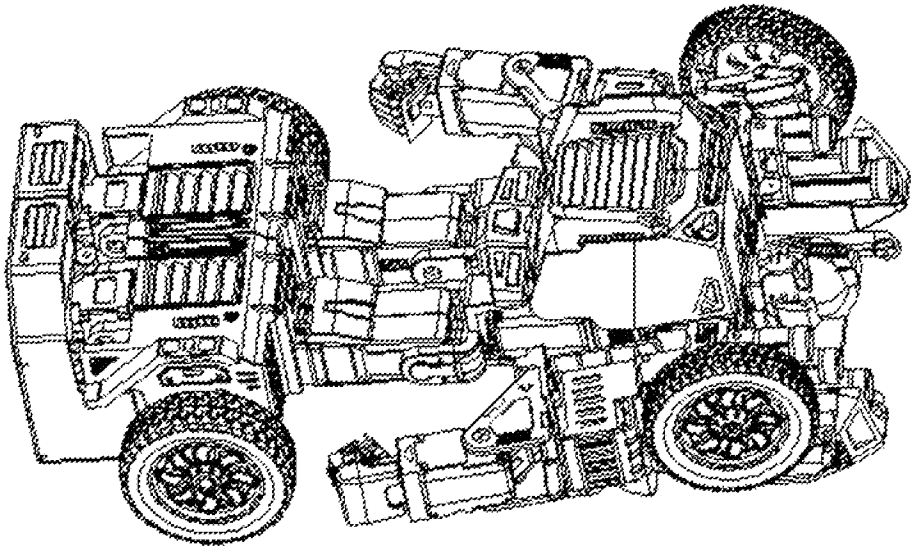
FIG. 23 is a form diagrammatic sketch for step seven of the transforming method of the transformable robot according to the present invention.
Figure 24:
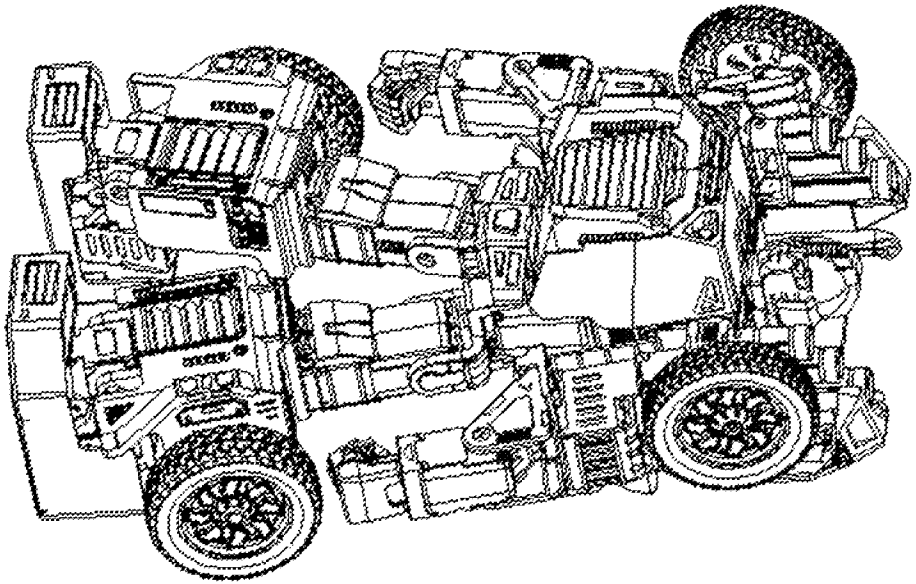
FIG. 24 is a form diagrammatic sketch for step eight of the transforming method of the transformable robot according to the present invention.

The transforming method of the transformable robot is elaborated in accordance with FIG. 17-FIG. 24.

The transforming method of the transformable robot includes the transforming process from the vehicle form to the robot form and the transforming process from the robot form to the vehicle form. The transformable robot implementing the two transforming processes refer to the transformable robot mentioned in the above embodiment. The transforming process from the vehicle form to the robot form includes:

step one: the transformable robot is powered on, and the transformation program is started;

step two: the left leg 8 and the right leg 1 are opened;

step three: the left arm 7 and the right arm 3 are opened, and the left leg 8 and the right leg 1 continue to be opened;

step four: the left arm 7 and the right arm 3 continue to be opened until they are perpendicular to the ground, and the left leg 8 and the right leg 1 continue to be opened;

step five: the left leg 8 and the right leg 1 continue to be opened until they are perpendicular to the ground;

step six: the car body 4, the car head 2 and the carriage 6 are opened partially, the left leg 8 and the right leg 1 are opened completely, and the left arm 7 and the right arm 3 are opened completely;

step seven: the car body 4, the car head 2 and the carriage 6 are turned forward 90 degrees, and the head 5 is protruded from the car body 4;

step eight: the left leg 8 and the right leg 1 are rotated outwards respectively, driving the left foot 229 and the right foot 189 to be rotated outwards respectively, then the combination formed by the left leg 8 and the left foot 229, the combination formed by the right leg 1 and the right foot 189 are separated from each other at a certain angle to form a stable standing state. The transformation process from the vehicle form to the robot form is completed.

The transformation process from the robot form to the vehicle form is the inverse process of the transformation process from the vehicle form to the robot form.

According to the present invention, the car head 2 and the carriage 6 are equipped in front of the car body 4 and at the back of the car body 4 respectively, both are improved in respect of the transformability, and therefore more different transformed shapes can be gotten, which results enjoy, and the robot provided in the present invention has much more value of generalization and usage.

It will be readily apparent to persons skilled in the relevant arts that the above description is only a preferred technical solution, in which the components involved and the connection relationship should not be limited, the components involved and the connection relationship may be modified and improved in addition to those already described, without departing from the basic inventive concepts of the present invention.

What is claimed is:

1. A transformable robot, comprising: a car body, a right leg and a left leg provided side by side under the car body, wherein a right arm is provided on a right side on an upper part of the car body and a left arm is provided on a left side on the upper part of the car body;

a car head is set in a front of the car body, a carriage is set on a back of the car body, a head of the transformable robot is set on a top of the car body;

wherein, the right leg, the left leg, the right arm, and the left arm are rotatably installed on the car body;

wherein the head of the transformable robot comprises a back part of the head, eyes, a face, a front part of the head, a neck, and a head supporting frame;

the eyes are set inside of the face, the face is set inside the back part of the head by a first round head self-tapping screw, the front part of the head is set on an outside of the face, the neck is set at a bottom of the head, the head supporting frame is installed at a bottom of the neck by a rotating shaft and a torsion spring, the torsion spring is assembled on the rotating shaft, and a printed circuit board (PCB) is set on an upper part of the neck.

2. The transformable robot according to the claim 1, wherein, the car body comprises sheet metal parts on the front of the car body and sheet metal parts under a steering gear for a grille;

a first part of waist, a second part of waist, a third part of waist, a fourth part of waist, the sheet metal parts under the steering gear for the grille and sheet metal parts above the steering gear for the grille are fixed on the sheet metal parts on the front of the car body; and a fifth steering gear for car body is set between the sheet metal parts under the steering gear for the grille and the sheet metal parts above the steering gear for the grille.

3. The transformable robot according to the claim 2, wherein, a bottom for the car head, an armpit, a first steering gear for the car body, a second steering gear for the car body, a third steering gear for the car body, a fourth steering gear for the car body and a fifth part of waist are set between the sheet metal parts on the front of the car body and sheet metal parts at the back of the car body;

the first steering gear for the car body and the second steering gear for the car body are fixed horizontally on the upper part of the car body side by side, the third steering gear for the car body and the fourth steering gear for the car body are fixed horizontally on a lower part of the car body side by side, and a PCB for control is installed on an other side of the sheet metal parts at the back of the car body.

4. The transformable robot according to the claim 1, wherein, the right arm comprises a hang frame for the right arm, a frame for a wheel at front right and a supporting frame for the wheel at front right, the hang frame for the right arm is connected with the frame for the wheel at front right, the frame for the wheel at front right is connected with the supporting frame for the wheel at front right, a fixing frame for the wheel at front right is installed on the supporting frame for the wheel at front right; and a tire at front right and a wheel at front right are successively equipped on the fixing frame for the wheel at front right.

5. The transformable robot according to the claim 4, wherein, the right arm comprises a second cover for the right arm;

a first cover for the right arm, a barrel on the right arm, a second U-shaped part on a right shoulder, a first U-shaped part on the right shoulder, a shaft for a right upper arm, a second spring and a mounting part for spring on the right arm are equipped on the second cover for the right arm.

6. The transformable robot according to the claim 5, wherein, the right arm comprises a forward frame for steering gear at an elbow of the right arm and a backward frame for steering gear at the elbow of the right arm;

a steering gear with metal teeth for the right arm is set between the forward frame for the steering gear at the elbow of the right arm and the backward frame for the steering gear at the elbow of the right arm.

7. The transformable robot according to the claim 6, wherein, the right arm comprises a third part of the elbow of the right arm, a first part of the elbow of the right arm, a second part of the elbow of the right arm, the elbow of the right arm, a right palm and a right wrist;

the third part of the elbow of the right arm, the first part of the elbow of the right arm and the second part of the elbow of the right arm are assembled together and an upper part thereof is connected with the elbow of the right arm, a lower part thereof is connected with the right wrist; and the right wrist is connected with the right palm.

8. The transformable robot according to the claim 1, wherein, the left arm comprises a hang frame for the left arm, a frame for a wheel at a front left and a supporting frame for the wheel at the front left;

the hang frame for the left arm is connected with the frame for the wheel at the front left, and the frame for the wheel at the front left is connected with the supporting frame for the wheel at the front left;

the supporting frame for the wheel at the front left is installed with a fixing frame for the wheel at the front left, and the fixing frame for the wheel at the front left is installed with a tire at the front left and the wheel at the front left in sequence.

9. The transformable robot according to the claim 8, wherein, the left arm comprises a second cover for the left arm; and the second cover for the left arm is installed with a first cover for the left arm, a barrel on the left arm, a second U-shaped part on a left shoulder, a first U-shaped part on the left shoulder, a shaft for a left upper arm, a sixth spring and a mounting part for the sixth spring on the left arm and the second cover for the left arm.

10. The transformable robot according to the claim 9, wherein, the left arm comprises a forward frame for a steering gear at an elbow of the left arm and a backward frame for the steering gear at the elbow of the left arm; and a steering gear with metal teeth for the left arm is set between the forward frame for the steering gear at the elbow of the left arm and the backward frame for the steering gear at the elbow of the left arm.

11. The transformable robot according to the claim 10, wherein, the left arm comprises a third part of the elbow of the left arm, a first part of the elbow of the left arm, a second part of the elbow of the left arm, a left palm and the elbow of left arm;

the third part of the elbow of the left arm, the first part of the elbow of left arm and the second part of the elbow of the left arm are assembled together and the upper part thereof is connected with the elbow of the left arm, a lower part thereof is connected with the left wrist; and the left wrist is connected with the left palm.

12. The transformable robot according to the claim 11, wherein, the left arm comprises a steering gear on a top of the left arm and a steering gear on a middle of the left arm, the steering gear on the top of the left arm is set on the top of the left arm, and the steering gear on the middle of the left arm is set on the middle of the left arm.

13. The transformable robot according to the claim 1, wherein, the right leg comprises a right foot, the right leg is installed with a sole of the right foot at a bottom of the right foot, and an instep of the right foot is installed on a top of right foot.

14. The transformable robot according to the claim 13, wherein, a first frame for the right foot, a second frame for the right foot, a second fixing plate for the right leg and a first fixing plate for the right leg are installed on a top of the instep of the right foot;

a third steering gear for the right leg is set between the second fixing plate for the right leg and the first fixing plate for the right leg, and a first steering gear for the right leg is equipped in a space formed by the first frame for the right foot, the second frame for the right foot, a first U-shaped part for the right foot and a second U-shaped part for the right foot.

15. The transformable robot according to the claim 14, wherein, the right leg comprises a right knee and an upper cover of the right knee; and the right knee is connected with the upper cover of the right knee by a torsion spring for the right leg and a shaft for the torsion spring for the right leg.

16. The transformable robot according to the claim 15, wherein, a cover for the right knee is equipped at a front of the right knee, an inside of the right leg is equipped on an outside of the right knee, and a fourth U-shaped part for the right leg is equipped on an upper part of an inside of the right leg.

17. The transformable robot according to the claim 16, wherein, the inside of the right leg and an outer of the right leg are arranged opposite to each other, and a fourth steering gear for the right leg and a fifth steering gear for the right leg are installed between the inside of right leg and the outer of the right leg side by side.

18. The transformable robot according to the claim 17, wherein, a third U-shaped part for the right leg is installed on an outside of the outer of right leg, the third U-shaped part for the right leg is installed on an outside of a fifth U-shaped part for the right leg, a first U-shaped part for the right leg and a second U-shaped part for the right leg are installed on a back of the inside of the right leg and the outer of the right leg, and a sixth U-shaped part for the right leg is installed on an outside of the second U-shaped part for the right leg.

19. The transformable robot according to the claim 18, wherein, a second U-shaped part on a cover for the right knee, a third fixing plate for the right leg, a second steering gear for the right leg, a wheel at a rear right and a tire at a rear right are successively provided on a lower part of the outer of right leg.

20. The transformable robot according to the claim 1, wherein, the left leg comprises a second fixing plate for the left leg and a first fixing plate for the left leg, and a third steering gear for the left leg is set between the second fixing plate for the left leg and the first fixing plate for the left leg.

21. The transformable robot according to the claim 20, wherein, the left leg comprises a first frame for a left foot, a second frame for the left foot, a first U-shaped part for the left foot and a second U-shaped part for the left foot, and a first steering gear for the left leg is provided in a space formed by the first frame for the left foot, the second frame for the left foot, the first U-shaped part for the left foot and the second U-shaped part for the left foot.

22. The transformable robot according to the claim 21, wherein, the left leg comprises a left knee and an upper cover of the left knee, the left knee is connected with the upper cover of the left knee by a torsion spring for the left leg and a shaft for the torsion spring for the left leg, and a cover for the left knee is provided at front of the left knee.

23. The transformable robot according to the claim 22, wherein, an inside of the left leg is provided on an outside of the left knee, a fourth U-shaped part for the left leg is provided on an upper of an inside of left leg;

the inside of the left leg and an outer of the left leg are arranged opposite to each other, and a fourth steering gear for the left leg and a fifth steering gear for the left leg are installed between the inside of the left leg and the outer of the left leg.

24. The transformable robot according to the claim 23, wherein, a third U-shaped part for the left leg is installed on an outside of the outer of the left leg, a fifth U-shaped part for the left leg is installed on an outside of the third U-shaped part for the left leg, a first U-shaped part for the left leg and a second U-shaped part for the left leg are installed on a back of the inside of the left leg and the outer of the left leg.

25. The transformable robot according to the claim 24, wherein, a sixth U-shaped part for the left leg is installed on an outside of the second U-shaped part for the left leg, and a second U-shaped part on a cover for the left knee, a third fixing plate for the left leg, a second steering gear for the left leg, a wheel at a rear left and a tire at the rear left are installed on a lower part of the outer of the left leg in sequence.

26. A transformable robot, comprising: a car body, a right leg and a left leg provided side by side under the car body, wherein a right arm is provided on a right side on an upper part of the car body and a left arm is provided on a left side on the upper part of the car body;

a car head is set in a front of the car body, a carriage is set on a back of the car body, a head of the transformable robot is set on a top of the car body;

wherein, the right leg, the left leg, the right arm, and the left arm are rotatably installed on the car body;

wherein the car head comprises a left car head, a right car head, a right torsional spring for the car head, a left torsional spring for the car head and a grille;

wherein the left car head and the right car head are connected with the grille by two fifth round head self-tapping screws, the right torsional spring of the car head, the left torsional spring for car head, a shim and a first flange self-tapping screw.

27. The transformable robot according to the claim 26, further comprising a left head light set inside of the left car head and a right head light set inside of the right car head;

wherein printed circuit boards for the head light are connected with the left car head and the right car head respectively;

in the left car head and the right car head, a first frame in the car head, two steering gears with metal teeth for the car head, and a second frame in the car head are internally equipped;

a left cover for the grille is set at a back of the left car head, and a right cover for the grille is set at a back of the right car head.

28. A transformable robot, comprising: a car body, a right leg and a left leg provided side by side under the car body, wherein a right arm is provided on a right side on an upper part of the car body and a left arm is provided on a left side on the upper part of the car body;

a car head is set in a front of the car body, a carriage is set on a back of the car body, a head of the transformable robot is set on a top of the car body;

wherein, the right leg, the left leg, the right arm, and the left arm are rotatably installed on the car body;

wherein, the carriage comprises a car roof;

an exhaust at a rear right, an exhaust at a front right, an exhaust at a front left, an exhaust at a rear left and a tailpipe are installed on a right side and a left side of the car roof;

a supporting frame for a roof light is installed in a rear of the car roof, and a PCB for the roof light, the roof light and a lampshade for the roof light are successively provided on the supporting frame for roof light.

29. The transformable robot according to the claim 28, wherein, the carriage includes a window;

wherein the window is connected with a lower part of the roof car roof by a first shaft for the carriage, a left torsion spring for the window and a right torsion spring for the window.

30. The transformable robot according to the claim 29, wherein, a horn, an acoustic chamber, a battery box, a battery, a cover for the battery box, a PCB for a microphone, a PCB for a switch, a charging interface, a button, a mini supporting frame, a USB interface and a microphone box are set at a front of the car roof.

31. The transformable robot according to the claim 30, wherein, a microphone box, the microphone, a cover for the microphone box and a rubber sleeve are set at a bottom of the car roof.

* * * * *